US010018950B2

(12) United States Patent
Kato

(10) Patent No.: US 10,018,950 B2
(45) Date of Patent: Jul. 10, 2018

(54) IMAGE FORMING APPARATUS WITH SWITCHING ROTATIONAL DIRECTION OF DEVELOPER CARRIER IN CORRESPONDENCE WITH INNER TEMPERATURE

(71) Applicant: Oki Data Corporation, Tokyo (JP)

(72) Inventor: Ken Kato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/657,961

(22) Filed: Jul. 24, 2017

(65) Prior Publication Data

US 2018/0024483 A1 Jan. 25, 2018

(30) Foreign Application Priority Data

Jul. 25, 2016 (JP) ..... 2016-145363

(51) Int. Cl.

| | |
|---|---|
| ***G03G 15/00*** | (2006.01) |
| ***G03G 15/08*** | (2006.01) |
| ***G03G 15/16*** | (2006.01) |

(52) U.S. Cl.

CPC ..... *G03G 15/50* (2013.01); *G03G 15/0865* (2013.01); *G03G 15/16* (2013.01)

(58) Field of Classification Search

CPC ..... G03G 15/50
USPC ..... 399/94
See application file for complete search history.

(56) References Cited

U.S. PATENT DOCUMENTS

| | | | | |
|---|---|---|---|---|
| 7,567,764 | B2 * | 7/2009 | Yamanaka | G03G 15/0812 399/284 |
| 9,454,105 | B1 * | 9/2016 | Onishi | G03G 15/0935 |
| 2007/0110482 | A1 * | 5/2007 | Kazaki | G03G 15/0812 399/279 |

FOREIGN PATENT DOCUMENTS

JP 2013-190770 A 9/2013

* cited by examiner

*Primary Examiner* — Quana M Grainger
(74) *Attorney, Agent, or Firm* — Muncy, Geissler, Olds & Lowe, P.C.

(57) ABSTRACT

An image forming apparatus includes an image forming unit, a developer carrier, a transfer part, a fuser, a temperature detecting part and a control part that rotates the developer carrier in the predetermined direction when a latent image is developed and in an opposite direction when an apparatus inner temperature detected by the temperature detecting part is equal to or higher than a glass transition starting temperature. The glass transition starting temperature is determined in consideration of a differential scanning calorimetry (DSC) curve of the toner.

9 Claims, 10 Drawing Sheets

IMAGE FORMING APPARATUS WITH SWITCHING ROTATIONAL DIRECTION OF DEVELOPER CARRIER IN CORRESPONDENCE WITH INNER TEMPERATURE

CROSS REFERENCE TO RELATED APPLICATIONS

This application claims priority under 35 USC 119 to Japanese Patent Application No. 2016-145363 filed on Jul. 25, 2016 original document, the entire contents which are incorporated herein by reference.

TECHNOLOGY FIELD

The present invention relates to an image forming apparatus for forming an image using a photosensitive drum.

BACKGROUND

An image forming apparatus of an electrophotographic system has been widely spread. This is because, compared with an image forming apparatus of other systems such as an inkjet system, a clear image can be obtained in a short time.

The image forming apparatus of an electrophotographic system is equipped with a photosensitive drum and forms an image on a surface of a medium using the photosensitive drum. In the image forming process, after an electrostatic latent image is formed on the surface of the photosensitive drum, toner is adhered to the electrostatic latent image. Therefore, a toner image is formed. The toner mage is transferred to the medium and then fused to the medium.

Regarding the configuration of an image forming apparatus, various proposals have already been made. Specifically, in order to suppress the toner from agglomerating, the photosensitive drum is rotated reversely at the end of the developing operation (see, for example, Patent Document 1).

RELATED ART

Patent Document

[Patent Doc. 1] JP Laid-Open Patent Publication 2013-190770

Although specific studies have been made to solve the problem due to toner agglomeration, the countermeasures have not been satisfactory yet, so there is room for improvement.

The present invention has been made in view of the above problems, and an object thereof is to provide an image forming apparatus capable of stably obtaining a high quality image.

SUMMARY

An image forming apparatus disclosed in the application includes: an image forming unit that includes an image carrier having a surface on which a latent image is formed, and a developer carrier which rotates in a predetermined direction and makes toner adhere to the latent image formed on the surface of the image carrier, and develops the latent image into a toner image; a transfer part that transfers the toner image formed by the image forming unit on a medium; a fuser that fuses the toner image transferred by the transfer part on the medium; a temperature detecting part that detects an apparatus inner temperature; and a control part that rotates the developer carrier in the predetermined direction when the latent image is developed and in an opposite direction to the predetermined direction when the apparatus inner temperature detected by the temperature detecting part is equal to or higher than a glass transition starting temperature.

<Glass Transition Starting Temperature>

The glass transition starting temperature is defined as a temperature corresponding to an intersection between a base line and a glass transition start judgment tangent line, which are specified based on a differential curve of a differential scanning calorimetry (DSC) curve of the toner measured using a DSC method, herein the horizontal axis of the DSC curve: temperature (° C.), the vertical axis of the DSC curve: calorific differential value (μW/° C.), the base line is a line along an initial section of the DSC curve in which the calorific differential value is approximately constant with respect to the calorific differential value, the glass transition start judgment tangent line is a tangent line which is in contact with the differential curve at an intersection between the differential curve and a glass transition start judgment line that is a line of which the calorific differential values are 1.5 times greater than those of the base line.

The "glass transition starting temperature" is, as apparent from the above definition, a unique value determined by this invention and a temperature that is determined from the differential curve of the DSC curve, a unique parameter of the invention and to be set lower than an actual glass transition temperature of toner. Specific protocol to determine the glass transition starting temperature is discussed later. The "apparatus inner temperature" is a temperature measured in anywhere inside the apparatus.

According to the image forming apparatus of one embodiment of the present invention, when the apparatus inner temperature is equal to or higher than a glass transition starting temperature, the developer carrier is rotated in a direction opposite to a predetermined direction, and thereby a toner agglomeration is prevented.

DETAILED EXPLANATIONS OF THE PREFERRED EMBODIMENT(S)

Hereinafter, an embodiment of the present invention will be described in detail with reference to the drawings. The order of description is as follows.

1. Image Forming Apparatus
1-1. Overall Structure
1-2. Structure of Developing Part
1-3. Block Configuration
1-4. Specifying Procedure of Glass Transition Starting Temperature
1-5. Toner Composition
1-6. Operation
1-7. Functions and Effects
2. Modified Example

Image Forming Apparatus

An image forming apparatus of one embodiment according to the present invention will be described.

<1-1. Overall Structure>

First, the overall structure of the image forming apparatus will be described.

The image forming apparatus described here is, for example, a full color printer of an electrophotographic system, and forms an image on a surface of a medium M (see later-described FIG. 1) using toner (so-called developer). The material of the medium M is not particularly limited, but it is, for example, one type or two or more types of a paper, a film, etc.

Figure 1:
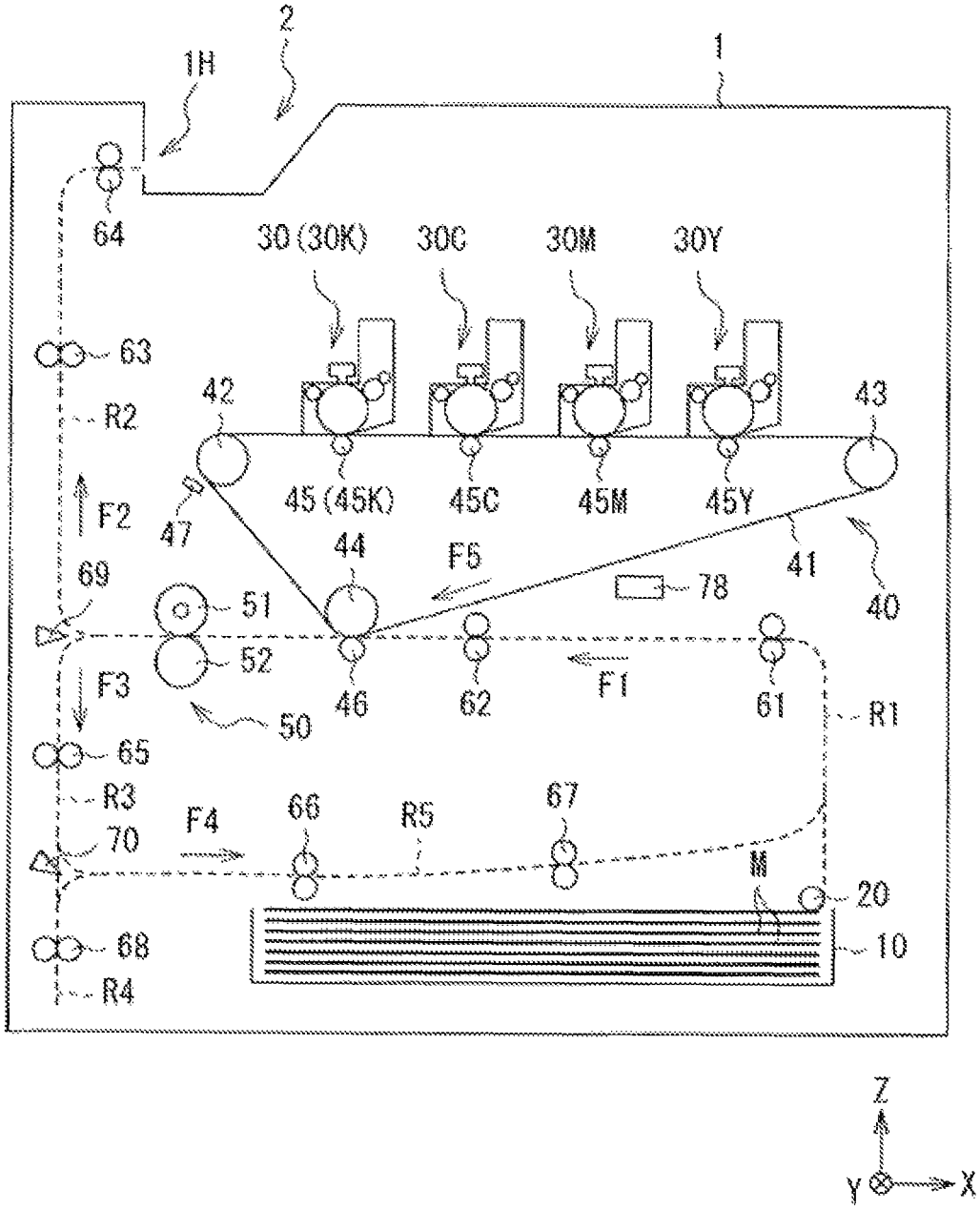
FIG. 1 is a plan view showing a configuration of an image forming apparatus according to an embodiment of the present invention.

FIG. 1 shows a planar configuration of the image forming apparatus. In this image forming apparatus, the medium M can be carried along the carrying paths R1 to R5. In FIG. 1, each of the carrying paths R1 to R5 is indicated by a broken line.

For example, as shown in FIG. 1, inside the housing 1, the image forming apparatus is provided with a tray 10, a feed roller 20, one or two or more developing parts 30 which is the "image forming unit" according to an embodiment of the present invention, a transfer part 40, a fuser 50, carrying roller 61 to 68, carrying path switching guides 69 and 70, and a temperature sensor 78 which is the "temperature detecting part" of one embodiment of the present invention.

[Housing]

The housing 1 includes one or two or more types of, for example, a metal material and a polymeric material. The housing 1 is provided with a stacker part 2 for discharging the medium M on which an image is formed, and the medium M on which the image is formed is discharged from an ejection opening 1H provided in the housing 1.

[Tray and Feed Roller]

The tray 10 is, for example, removably installed in the housing 1 and contains mediums M. For example, the feed roller 20 extends in the Y axis direction and is rotatable about the Y axis. Among a series of constituent elements described below, constituent elements including the term "roller" in the name are extended in the Y-axis direction and rotatable about the Y-axis in the same manner as in the feed roller 20.

In this tray 10, for example, a plurality of mediums M is contained in a stacked state. The plurality of mediums M contained in the tray 10, for example, is taken out one by one from the tray 10 by the feed roller 20.

The number of trays 10 and the number of feed rollers 20 are not particularly limited, and may be one or two or more. In FIG. 1, for example, it shows the case in which the number of trays 10 is one and the number of feed rollers 20 is one.

[Developing Part]

The developing part 30 performs a forming process (development process) of a toner image using toner. Specifically, the developing part 30 primarily forms a latent image (electrostatic latent image) and a toner image by making the toner adhere to the electrostatic latent image using a Coulomb force.

Here, the image forming apparatus is equipped with, for example, four developing parts 30 (30K, 30C, 30M, and 30Y).

Each of the developing parts 30K, 30C, 30M, and 30Y is installed, for example, removably with respect to the housing 1, and arranged along the movement path of the intermediate transfer belt 41, which will be described later. Here, the developing parts 30K, 30C, 30M, and 30Y are arranged, for example, in this order from the upstream side to the downstream side in the moving direction (F5) of the intermediate transfer belt 41.

Each of the developing parts 30K, 30C, 30M, and 30Y has the same structure except that, for example, the type (color) of toner contained in the cartridge 39 (see FIG. 2) is different. The respective developing parts 30K, 30C, 30M, and 30Y will be described later.

[Transfer Part]

The transfer part 40 performs a transfer process of a toner image formed by the developing part 30. Specifically, the transfer part 40 mainly transfers the toner image formed by the developing part 30 to the medium M.

The transfer part 40 includes, for example, an intermediate transfer belt 41, a drive roller 42, a driven roller (idler roller) 43, a backup roller 44, one or two or more primary transfer rollers 45, a secondary transfer roller 46, and a cleaning blade 47.

The intermediate transfer belt 41 is a medium (intermediate transfer medium) to which the toner image is temporarily transferred before the toner image is transferred to the medium M, and is, for example, an endless elastic belt. The intermediate transfer belt 41 contains, for example, one or two or more types of polymer materials such as polyimide. The intermediate transfer belt 41 is movable in accordance with the rotation of the drive roller 42 in a state of being stretched by the drive roller 42, the driven roller 43, and the backup roller 44.

The drive roller 42 is, for example, rotatable using a driving force of a later-described roller motor 85 (see FIG. 3). Each of the driven roller 43 and the backup roller 44 is rotatable in accordance with the rotation of the drive roller 42.

The primary transfer roller 45 transfers (primarily transfers) the toner attached to the electrostatic latent image (toner image) to the intermediate transfer belt 41. This primary transfer roller 45 is press-contacted to the developing part 30 (later-described photosensitive drum 31: see FIG.

2) via the intermediate transfer belt 41. The primary transfer roller 45 is rotatable in accordance with the movement of the intermediate transfer belt 41.

Here, the transfer part 40 includes, for example, four primary transfer rollers 45 (45K, 45C, 45M, 45Y) corresponding to the aforementioned four developing parts 30 (30K, 30C, 30M, 30Y). The transfer part 40 includes one secondary transfer roller 46 corresponding to one backup roller 44.

The secondary transfer roller 46 transfers (secondly transfers) the toner image transferred to the intermediate transfer belt 41 to the medium M.

This secondary transfer roller 46 is press-contacted to the backup roller 44 and includes, for example, a metallic core and an elastic layer such as a foamed rubber layer covering the outer peripheral surface of the core. The secondary transfer roller 46 is rotatable according to the movement of the intermediate transfer belt 41.

The cleaning blade 47 is press-contacted to the intermediate transfer belt 41 to scrape unnecessary developers remaining on the surface of the intermediate transfer belt 41.

[Fuser]

The fuser 50 performs a fusing process of the toner image transferred to the medium M by the transfer part 40. Specifically, the fuser 50 fuses, for example, the toner image to the medium M by pressurizing the toner image transferred to the medium M by the transfer part 40 while heating.

The fuser 50 includes, for example, a heat application roller 51 and a pressure application roller 52.

The heat application roller 51 is configured to heat the toner image. The heat application roller 51 includes, for example, a hollow cylindrical metal core and a resin coating covering the surface of the metal core. The metal core contains, for example, any one type or two or more types of metal materials such as, e.g., aluminum. The resin coating includes, for example, any one or two or more types of polymer materials such as a copolymer of tetrafluoroethylene and perfluoroalkyl vinyl ether (PFA) and polytetrafluoroethylene (PTFE).

Inside the heat application roller 51 (metal core), for example, a later-described heater 93 (see FIG. 3) is installed, and the heater 93 is, for example, a halogen lamp. In the vicinity of the heat application roller 51, a later-described thermistor 94 (see FIG. 3) is disposed at a position distant from the heat application roller 51. This thermistor 94 measures, for example, the surface temperature of the heat application roller 51.

The pressure application roller 52 is press-contacted to the heat application roller 51 and pressurizes the toner image. This pressure application roller 52 is, for example, a metal rod, etc. This metal rod includes, for example, one type or two or more types of metal materials such as aluminum.

[Carrying Roller]

Each of the carrying rollers 61 to 68 includes a pair of rollers arranged so as to face each other via the carrying paths R1 to R5 of the medium M and carries the medium M taken out by the feed roller 20.

When an image is formed on only one side of the medium M, the medium M is carried, for example, by the carrying rollers 61 to 64 along the carrying paths R1 and R2. When images are formed on both sides of the medium M, the medium M is carried, for example, by the carrying rollers 61 to 68 along the carrying paths R1 to R5.

[Carrying Path Switching Guide]

The carrying path switching guides 69 and 70 change the carry direction of the medium M depending on the conditions of the manner of the image to be formed on the medium M (whether the image is formed on only one side of the medium M or the image is formed on both sides of the medium M).

[Temperature Sensor]

The temperature sensor 78 detects the temperature of the inside portion of the image forming apparatus (apparatus inner temperature T) in order to judge whether or not the reverse rotation operation of the later-described development roller 33 is necessary. This temperature sensor 78 includes, for example, one or two or more types of a thermometer, a thermocouple, and the like.

The apparatus inner temperature T is measured to determine the agglomeration state of the toner used inside the image forming apparatus as described below. This "agglomeration state of the toner" means, for example, whether or not a part of the toner is agglomerated due to thermal damage of the toner and deterioration of the toner. The tendency of the toner agglomeration becomes conspicuous, for example, as the particle diameter of the toner becomes smaller and the melting point of the toner becomes lower.

Accordingly, the position of the temperature sensor 78 is not particularly limited as long as it is a position where the apparatus inner temperature T can be measured. Specifically, for example, the temperature sensor 78 may be provided in the developing part 30 itself to directly measure the temperature of the developing part 30 in which the toner is stored as the apparatus inner temperature T. Alternatively, for example, the temperature sensor 78 may be arranged around the developing part 30 to indirectly measure the temperature of the developing part 30 in which the toner is stored, as the apparatus inner temperature T.

Here, for example, the temperature sensor 78 is arranged in the vicinity of the intermediate transfer belt 41 to indirectly measure the temperature of the developing part 30 in which the toner is stored as the apparatus inner temperature T. In this case, the temperature sensor 78 measures, for example, the temperature of the transfer part 40 (intermediate transfer belt 41) as the apparatus inner temperature T.

<1-2. Structure of Developing Part>

Next, the configuration of the developing part 30 will be described.

Figure 2:
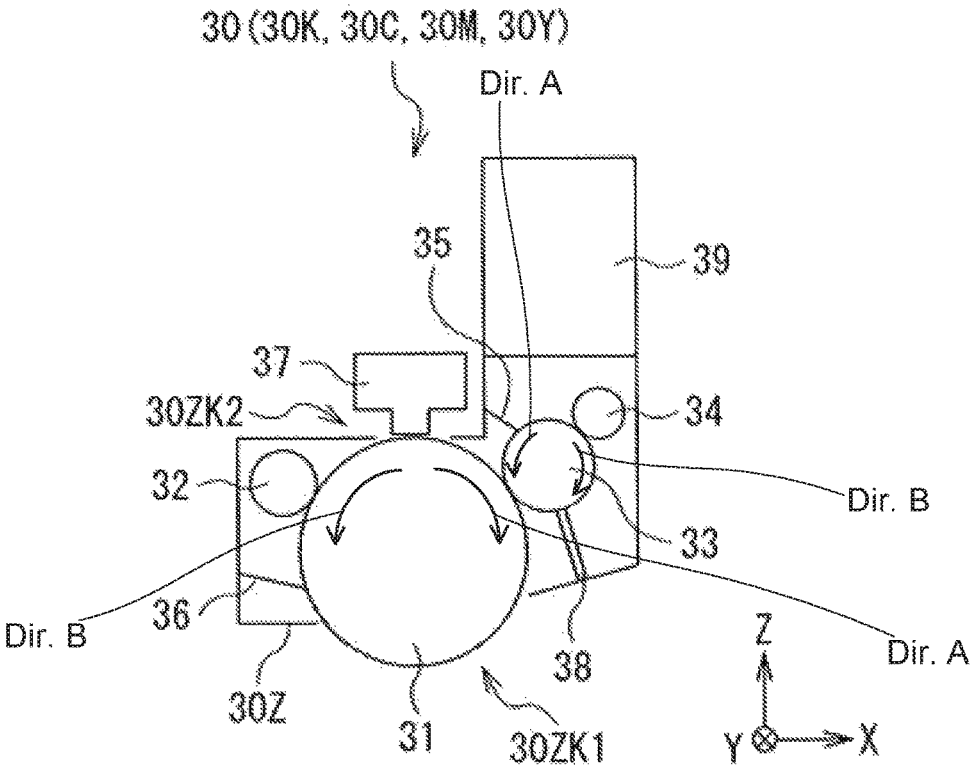
FIG. 2 is an enlarged plan view showing a configuration of a developing part shown in FIG. 1.

FIG. 2 is an enlarged planar configuration of the developing part 30 (30K, 30C, 30M, and 30Y) shown in FIG. 1.

As shown in FIG. 2, for example, each of the developing parts 30K, 30C, 30M, and 30Y includes, within the housing 30Z, a photosensitive drum 31 which is an "image carrier" according to an embodiment of the present invention, a charge roller 32, a development roller 33 which is a "developer carrier" according to one embodiment of the present invention, a supply roller 34, a development blade 35, a cleaning blade 36, a light source 37, and a development seal 38. To this housing 30Z, for example, a cartridge 39 is detachably installed.

[Photosensitive Drum]

The photosensitive drum 31 is, for example, an organic-system photoreceptor including a cylindrical conductive supporting body and a photoconductive layer covering the outer peripheral surface of the conductive supporting body, and is rotatable via a driving source of a later-described drum motor 87 (see FIG. 3). The conductive supporting body is, for example, a metal pipe containing one or two or more types of metal materials such as aluminum. The photoconductive layer is a laminated body including, for example, a charge generation layer and a charge transportation layer. A part of the photosensitive drum 31 is exposed from the opening 30ZK1 provided in the housing 30Z.

The photosensitive drum 31 is rotatable at the time of forming an image. As apparent from FIGS. 1 and 2, for example, the rotational direction of the photosensitive drum 31 is a direction in which the photosensitive drum 31 rotates in accordance with the movement of the intermediate transfer belt 41, more specifically, in the counterclockwise rotational direction. In FIG. 2, the normal rotational direction of the image carrier, which is a predetermined direction, is denoted with Dir. A. The reverse direction, which is opposite to the predetermined direction, is denoted with Dir. B.

The developing part 30 including the photosensitive drum 31 can move up and down as necessary. More specifically, for example, the developing part 30 moves downward at the time of forming an image until the photosensitive drum 31 comes into contact with the intermediate transfer belt 41. On the other hand, the developing part 30, for example, moves upward so that the photosensitive drum 31 is separated from the intermediate transfer belt 41 at the time of not forming an image.

[Charge Roller]

The charge roller 32 includes, for example, a metal shaft and a semiconductive epichlorohydrin rubber layer covering the outer peripheral surface of the metal shaft. This charge roller 32 is press-contacted to the photosensitive drum 31 in order to charge the photosensitive drum 31.

[Development Roller]

The development roller 33 includes, for example, a metal shaft and a semiconductive urethane rubber layer covering the outer peripheral surface of the metal shaft. This development roller 33 carries the toner supplied from the supply roller 34 and makes the toner adhere to the electrostatic latent image formed on the surface of the photosensitive drum 31.

This development roller 33 is rotatable in a predetermined direction at the time of forming an image. For example, as will be apparent from FIGS. 1 and 2, this "predetermined direction" denotes a direction (see Dir. A in FIG. 2) in which the development roller 33 rotates in accordance with the rotation of the photosensitive drum 31, more specifically a clockwise rotational direction.

In particular, the development roller 33 is rotatable in a direction opposite to the above-mentioned predetermined direction as required, in other words, it is rotatable in the reverse direction. For example, as will be apparent FIGS. 1 and 2, this "direction opposite to the predetermined direction" is a direction (see Dir. B in FIG. 2) opposite to the direction in which the development roller 33 rotates according to the rotation of the photosensitive drum 31, more specifically a counterclockwise rotational direction. In FIG. 2, the normal rotational direction of the developer carrier, which is a predetermined direction, is denoted with Dir. A. The reverse direction, which is opposite to the predetermined direction, is denoted with Dir. B.

[Supply Roller]

The supply roller 34 includes, for example, a metal shaft and a semiconductive foamed silicon sponge layer covering the outer peripheral surface of the metal shaft, and is a so-called sponge roller. This supply roller 34 supplies toner to the surface of the development roller 33 while sliding on the development roller 33.

[Development Blade]

The development blade 35 controls the thickness of the toner supplied to the surface of the development roller 33. For example, the development blade 35 is arranged at a position separated from the development roller 33 by a predetermined distance, and the thickness of the toner is controlled based on the distance (space) between the development roller 33 and the development blade 35. Further, the development blade 35 contains, for example, one or two or more types of metallic materials such as stainless steel, etc.

[Cleaning Blade]

The cleaning blade 36 is configured to scrape unnecessary toner remaining on the surface of the photosensitive drum 31. This cleaning blade 36 extends, for example, in a direction substantially parallel to the extending direction of the photosensitive drum 31 and is in pressure contact with the photosensitive drum 31. Further, the cleaning blade 36 contains, for example, one or two or more types of polymeric materials such as, e.g., urethane rubber.

[Light Source]

The light source 37 is an exposure device for forming an electrostatic latent image on the surface of the photosensitive drum 31 by exposing the surface of the photosensitive drum 31 through the opening 30ZK2 provided in the housing 30Z. This light source 37 is, for example, a light emitting diode (LED) head, and includes an LED element, a lens array, etc. The LED element and the lens array are arranged so that the light (irradiated light) output from the LED element forms an image on the surface of the photosensitive drum 31.

[Development Seal]

The development seal 38 seals the movement path of the toner inside the housing 30Z in order to prevent the toner remaining inside the housing 30Z from unintentionally being discharged to the outside through the opening 30ZK1, etc.

Specifically, for example, the development seal 38 is arranged so that one end portion thereof is in contact with the development roller 33 and the other end portion thereof is in contact with the housing 30Z to thereby seal the gap between the development roller 33 and the housing 30Z.

This development seal 38 is, for example, in the form of a sheet and contains one or two or more types of polymeric materials such as urethane rubber.

[Cartridge]

The cartridge 39 contains toner. The type (color) of the toner stored in the cartridge 39 is, for example, as follows.

Here, for example, four types (four colors) of toner are used. Specifically, the cartridge 38 of the developing part 30K contains, for example, black toner. The cartridge 38 of the developing part 30C contains, for example, cyan toner. The cartridge 38 of the developing part 30M contains, for example, magenta toner. The cartridge 38 of the developing part 30Y contains, for example, yellow toner.

<1-3. Block Configuration>

Next, the block configuration of the image forming apparatus will be explained.

Figure 3:
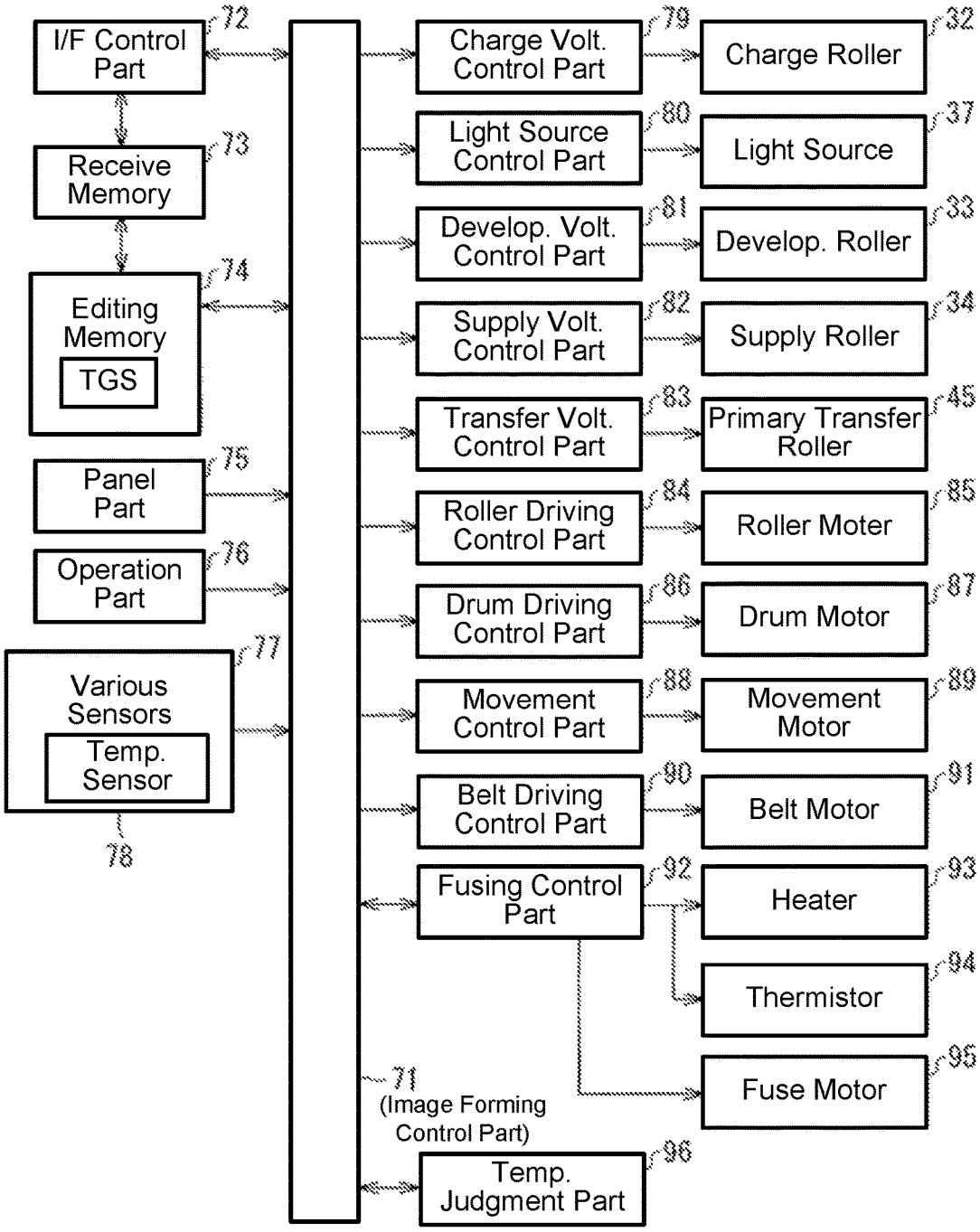
FIG. 3 is a block diagram showing a configuration of the image forming apparatus.

FIG. 3 illustrates a block configuration of the image forming apparatus. FIG. 3 shows a part of the constituent elements of the image forming apparatus which has been already described.

For example, as shown in FIG. 3, the image forming apparatus is provided with an image forming control part 71, an interface (I/F) control part 72, a receive memory 73, an editing memory 74, a panel part 75, an operation part 76, various sensors 77, a charge voltage control part 79, a light source control part 80, a development voltage control part 81, a supply voltage control part 82, a transfer voltage control part 83, a roller driving control part 84, a drum driving control part 86, a movement control part 88, a belt driving control part 90, a fusing control part 92, and a temperature judgment part 96. The roller driving control part 84 is the "rotation control part" of the embodiment of the present invention, and the image forming control part 71, the roller driving control part 84, and the temperature judgment part 96 are the "control part" of one embodiment of the present invention.

The image forming control part 71 mainly controls the entire operation of the image forming apparatus. The image forming control part 71 includes, for example, one or two or more types of control circuits such as a central processing unit (CPU).

The interface (I/F) control part 72 mainly receives information such as data transmitted from the external device to the image forming apparatus. This external device is, for example, a personal computer usable by a user of the image forming apparatus, and the information transmitted from the external device to the image forming apparatus is, for example, image data for forming an image.

The receive memory 73 mainly stores information such as data received by the image forming apparatus.

The editing memory 74 mainly stores data (edited image data) in which image data is edited. This edited image data is used, for example, to form an image in the image forming apparatus. Besides this, the editing memory 74 may store information such as parameters necessary for the operation of the image forming apparatus. The information stored in the editing memory 74 can be rewritten, for example, as necessary. The information stored in the editing memory 74 is, for example, a glass transition starting temperature TGS which will be described later. The details of this glass transition starting temperature TGS will be described later (see FIGS. 4 to 7).

The panel part 75 mainly includes a display panel and the like for displaying information necessary for a user to operate the image forming apparatus. The type of the display panel is not particularly limited, but is, for example, a liquid crystal panel. The operation part 76 mainly includes buttons and the like to be operated by a user at the time of operating the image forming apparatus.

Various sensors 77 mainly include the temperature sensor 78, etc., mentioned above. However, since the type of various sensors 77 is not particularly limited, it may include one or two or more types of sensors other than the temperature sensor 78 and other sensors such as a humidity sensor.

The charge voltage control part 79 mainly controls the voltage, etc., to be applied to the charge roller 32. The light source control part 80 mainly controls the exposure operation of the light source 37, etc. The development voltage control part 81 mainly controls the voltage to be applied to the development roller 33, etc. The supply voltage control part 82 mainly controls the voltage to be applied to the supply roller 34, etc. The transfer voltage control part 83 mainly controls the voltage to be applied to the primary transfer roller 45, etc.

In FIG. 3, the illustrated contents are simplified, but the image forming apparatus includes, for example, four charge voltage control parts 79 corresponding to the developing parts 30K, 30C, 30M, and 30Y. Specifically, for example, the image forming apparatus includes a charge voltage control part 79 for controlling the applied voltage of the charge roller 32 mounted on the developing part 30K, a charge voltage control part 79 for controlling the applied voltage of the charge roller 32 mounted on the developing part 30C, a charge voltage control part 79 for controlling the applied voltage of the charge roller 32 mounted on the part 30M, and a charge voltage control part 79 for controlling the applied voltage of the charge roller 32 mounted on the developing part 30Y.

The explanation about the charge voltage control part 79 can also be applied to, for example, the light source control part 80, the development voltage control part 81, the supply voltage control part 82, and the transfer voltage control part 83. That is, the image forming apparatus has four light source control parts 80, four development voltage control parts 81, four supply voltage control parts 82, and four transfer voltage control parts 83 corresponding to the developing parts 30K, 30C, 30M, 30Y.

The roller driving control part 84 mainly controls the rotation operation, etc., of a series of rollers such as a charge roller 32, a development roller 33, and a supply roller 34 via a roller motor 85. The drum driving control part 86 mainly controls the rotation operation, etc., of the photosensitive drum 31 via the drum motor 87. The movement control part 88 mainly controls the moving operation, etc., of the developing part 30 via the movement motor 89. The belt driving control part 90 mainly controls the moving operation, etc., of the intermediate transfer belt 41 via the belt motor 91. The fusing control part 92 mainly controls the temperature of the heater 93 based on the temperature measured by the thermistor 94 and controls the respective rotation applications, etc., of the heat application roller 51 and the pressure application roller 52 via the fuse motor 95.

This roller driving control part 84 in particular reversely rotates the development roller 33 if necessary. More specifically, in cases where the temperature judgment part 96 determines that the apparatus inner temperature T is equal to or higher than the glass transition starting temperature TGS, when a reverse rotation signal is output from the temperature judgment part 96, the roller driving control part 84 reversely rotates the development roller 33 via the roller motor 85 in accordance with the reverse rotation signal.

The above described with respect to the charge voltage control part 79 can also be applied to each of the roller driving control part 84, the drum driving control part 86, and the movement control part 88. That is, the image forming apparatus includes, for example, four roller driving control parts 84, four drum driving control parts 86, and four movement control parts 88.

When the apparatus inner temperature T is detected by the temperature sensor 78, the temperature judgment part 96 mainly judges whether or not the apparatus inner temperature T is equal to or higher than the glass transition starting temperature TGS. When it is judged that the apparatus inner temperature T is equal to or higher than the glass transition starting temperature TGS, the temperature judgment part 96 outputs a reverse rotation signal to the roller driving control part 84 to reversely rotate the development roller 33.

<1-4. Specifying Procedure of Glass Transition Starting Temperature>

Next, the glass transition starting temperature TGS will be described.

Figure 4:
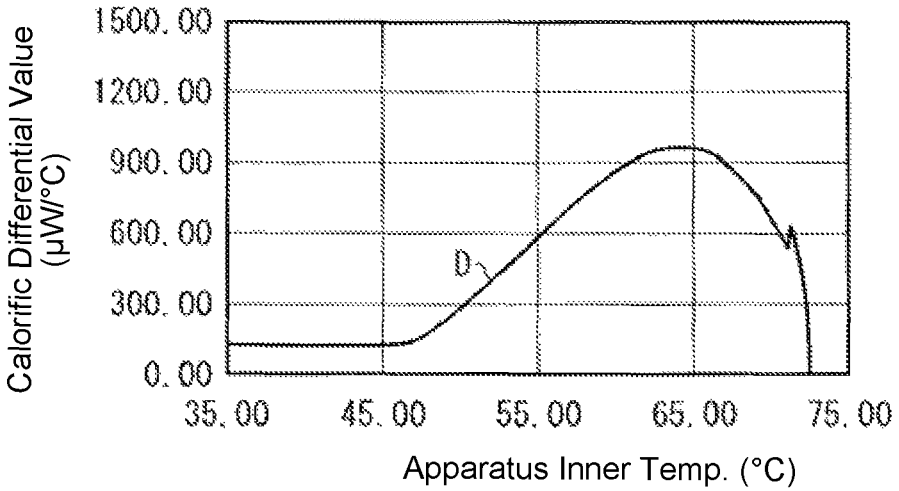
FIG. 4 shows a differential curve of a DSC curve measured using toner A in order to explain a specifying procedure of a glass transition starting temperature TGS for the toner A.
Figure 5:
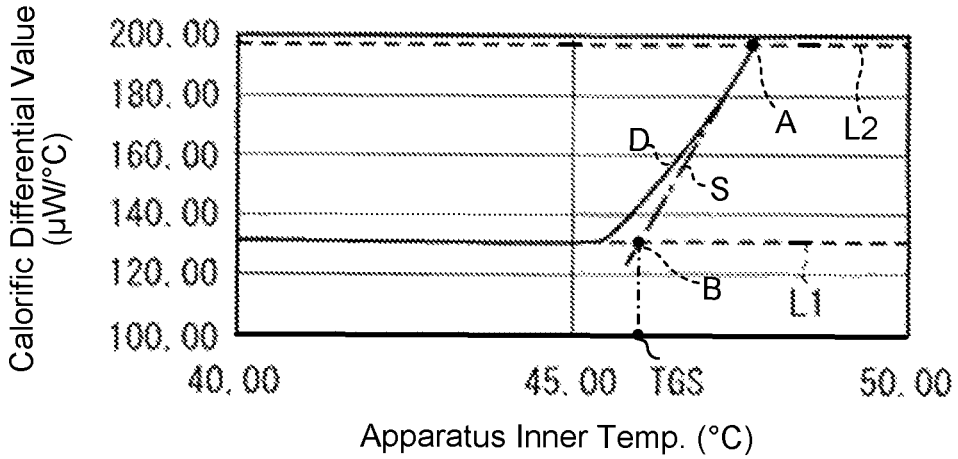
FIG. 5 is an enlarged part of the differential curve shown in FIG. 4.

FIGS. 4 and 5 each illustrate a differential curve (DDSC curve D) of the DSC curve measured using the toner A in order to explain the specifying procedure of the glass transition starting temperature TGS related to the toner A. Further, FIGS. 6 and 7 each illustrate a differential curve (DDSC curve D) of the DSC curve measured using the toner B in order to explain the specifying procedure of the glass transition starting temperature TGS related to the toner B. The DSC curve stands for a differential scanning calorimetry curve. With respect to the measurement of DSC, which includes the measuring method and the measuring structures and devices, US patent application publication 2016/0282738 is incorporated herein by reference.

Figure 6:
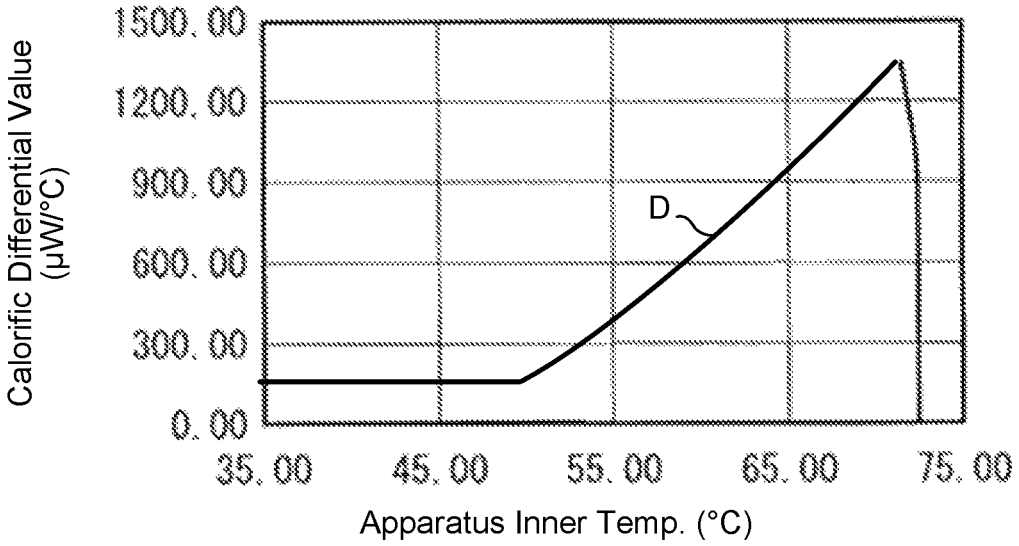
FIG. 6 shows a differential curve of a DSC curve measured using toner B in order to explain a specifying procedure of a glass transition starting temperature TGS for the toner B.
Figure 7:
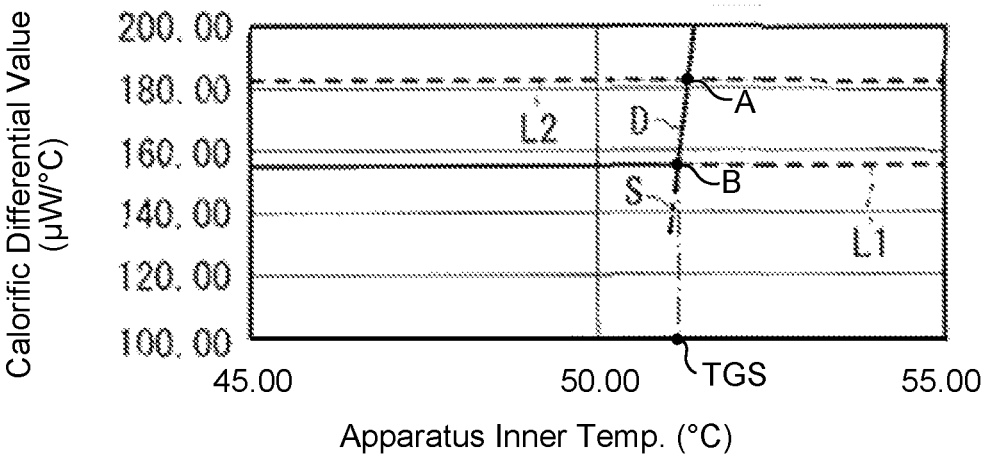
FIG. 7 is an enlarged part of the differential curve shown in FIG. 6.

Note that, in FIG. 5, a part of the DDSC curve D shown in FIG. 4 is enlarged, and in FIG. 7, a part of the DDSC curve D shown in FIG. 6 is enlarged.

The toners A and B described here have the same configuration except that the glass transition temperatures Tg are different due to the type of the binding agent being different. The respective configurations of the toners A and B will be described later (see Examples).

As described above, the glass transition starting temperature TGS denotes a temperature corresponding to the intersection B of a base line L1 and the glass transition start judgment tangent line S when the base line L1, a glass transition start judgment line L2, and the glass transition start judgment tangent line S are specified based on the DDSC curve D (horizontal axis: temperature (° C.), vertical axis: calorific differential value (μW/° C.)) of the toner. The base line L1 is a line along the initial DDSC curve D in which the calorific differential value is substantially constant. The glass transition start judgment line L2 is a line of a calorific differential value corresponding to 1.5 times the calorific differential value of the base line L1. The glass transition start judgment tangent line S is a tangent line that contacts the DDSC curve D at the intersection A of the DDSC curve D and the glass transition start judgment line L2.

The specifying procedure of the glass transition starting temperature TGS for the toner A is as follows.

First, by analyzing the toner A using the DSC method, a DSC curve related to the toner A is obtained. This DSC curve is a curve in which the temperature (° C.) is plotted on the horizontal axis and the heat flow value (μW) is plotted on the vertical axis. The type of the analyzer used for obtaining the DSC curve is not particularly limited, but, for example, a differential scanning calorimeter EXSTAR DSC6000 manufactured by SII NanoTechnology Inc., can be exemplified.

In the case of analyzing the toner A using the DSC method, for example, the temperature of the toner A is raised from 20° C. to 200° C. at a temperature raising rate of 10° C./min and then cooled at a temperature dropping rate of 90° C./min from 200° C. to 0° C. Subsequently, for example, the temperature of the toner A is raised from 0° C. to 20° C. at a temperature raising rate of 60° C./min and then the temperature of the toner A is raised from 20° C. to 200° C. at a temperature raising rate of 10° C./min. The DSC curve described above is measured in the first temperature raising process.

Subsequently, by differentiating the heat flow value on the vertical axis, a DDSC curve D is obtained as shown in FIG. 4. The DDSC curve D is a curve in which the temperature (° C.) is plotted on the horizontal axis and the calorific differential value (μW/° C.) is plotted on the vertical axis.

In the DDSC curve D shown in FIG. 4, the calorific differential value does not change as the temperature rises in the early stage, but gently increases after the middle stage as the temperature rises and thereafter gradually decreases.

Subsequently, as shown in FIG. 5, a part of the DDSC curve D shown in FIG. 4, specifically the DDSC curve D at the point where the calorific differential value begins to increase and its vicinity is enlarged. The range to be expanded among the DDSC curve D is not particularly limited. Here, for example, the range in which the temperature=40.00° C. to 50.00° C. and the calorific differential value=100.00 μW/° C. to 200.00 μW/° C. is enlarged.

Subsequently, a base line L1 is specified based on the DDSC curve D. As described above, this base line L1 is a line along the initial DDSC curve D in which the calorific differential value is substantially constant, more specifically a line obtained by extending the initial DDSC curve D. Specifically, the method of identifying the base line L1 is, for example, in accordance with JIS K7121. In FIG. 5, the base line L1 is indicated by a broken line.

Subsequently, a glass transition start judgment line L2 is specified based on the base line L1. This glass transition start judgment line L2 is a line of the calorific differential value corresponding to 1.5 times the calorific differential value of the base line L1 as described above. The reason that the calorific differential value of the glass transition start judgment line L2 is set so as to be 1.5 times the calorific differential value of the base line L1 is as follows. That is, from the experience, when the DDSC curve D for the toner A is acquired multiple times, the value obtained by multiplying the calorific differential value of each base line L1 by 1.5 is larger than the sum of the average value of the calorific differential values of a plurality of base lines L1 and three times the standard deviation of the average value thereof. For this reason, from the viewpoint of six sigma, which is an indicator showing the degree of variation from the average value, it is considered to be effective in identifying the glass transition starting temperature TGS so that the calorific differential value of the glass transition start judgment line L2 is set to be 1.5 times the calorific differential value of the base line L1. Here, for example, since the calorific differential value of the base line L1 is about 130.00 μW/° C., the calorific differential value of the glass transition start judgment line L2 is about 195 μW/° C. In FIG. 5, the glass transition start judgment line L2 is indicated by a broken line.

Subsequently, a glass transition start judgment tangent line S is drawn based on the DDSC curve D and the glass transition start judgment line L2. As described above, this glass transition start judgment tangent line S is a tangential line that contacts the DDSC curve D at the intersection A of the DDSC curve D and the glass transition start judgment line L2. In FIG. 5, the glass transition start judgment tangent line S is indicated by a chain line.

Finally, after identifying the intersection B of the glass transition start judgment tangent line S and the base line L1, the temperature corresponding to the intersection B is set as a glass transition starting temperature TGS. As a result, the base line L1, the glass transition start judgment line L2, the intersections A and B, and the glass transition start judgment tangent line S are specified on the basis of the DDSC curve D, so that the glass transition starting temperature TGS is specified based on the intersection B.

In the case of using the toner A (FIGS. 4 and 5), the glass transition starting temperature TGS is, for example, about 46° C.

As described above, this glass transition starting temperature TGS is a temperature (a parameter unique to the present invention) obtained from the DDSC curve D relating to the toner A, and is a reference value (threshold value) to be compared with the apparatus inner temperature T to determine the agglomerate state of the toner used in the developing part 30. As described above, the glass transition starting temperature TGS is lower than the glass transition temperature Tg of the actual toner A.

In detail, As is apparent from the fact that the glass transition starting temperature TGS is a temperature near the temperature at which the calorific differential value begins to increase in the DDSC curve D shown in FIG. 4, it is considered that the toner A begins agglomerating according to the increase in the apparatus inner temperature T. That is, when the apparatus inner temperature T becomes equal to or higher than the glass transition starting temperature TGS, the state of the toner A starts to change so as to be in a fluid state. Therefore, after that the toner A begins microscopically agglomerate (soft agglomerate), it will macroscopically start to agglomerate. For this reason, the glass transition starting temperature TGS is considered to be the temperature at which the toner A begins microscopically agglomerate. Therefore, the glass transition starting temperature TGS is a limit value (critical value) of the temperature which does not affect the image quality due to the agglomerate of the toner A, which is a reference value (threshold value) to be compared with the apparatus inner temperature T so as not to affect the quality of the image due to the agglomerate of the toner A.

The specifying procedure of the glass transition starting temperature TGS can be similarly applied even if the type of the toner is changed.

Specifically, even in cases where toner B is used instead of the toner A, the glass transition starting temperature TGS can be specified as shown in FIGS. 6 and 7.

In the DDSC curve D relating to the toner B, unlike the above-mentioned DDSC curve D of the toner A, as shown in FIG. 6, the calorific differential value does not change according to the temperature rise in the early stage, but after the middle stage, it increases sharply as the temperature rises and then decreases sharply.

In this case as well, as shown in FIG. 7, by specifying the base line L1, the glass transition start judgment line L2, the intersections A and B, and the glass transition start judgment tangent line S based on the DDSC curve D, based on the intersection B, it is possible to identify the glass transition starting temperature TGS.

In the case of using the toner B (FIGS. 6 and 7), the glass transition starting temperature TGS is, for example, about 51° C.

<1-5. Configuration of Toner>

Next, the configuration of the toner will be described.

Each of yellow toner, magenta toner, cyan toner, and black toner is, for example, toner of a single component development system, more specifically negatively charged toner.

The single component development system is a system in which an appropriate charge amount is given to the toner itself without using a carrier (magnetic particle) to give an electric charge to the toner. On the other hand, the two component development system is a system in which the carrier and toner are mixed so that an appropriate charge amount is given to the developer using the friction between the carrier and the developer.

Yellow toner, for example, contains a yellow coloring agent. However, yellow toner, together with a yellow coloring agent, may contain any one or two or more types of other materials.

The yellow coloring agent includes one or two or more types of yellow pigment and yellow dye (pigment), for example. The yellow pigment is, for example, pigment yellow 74 or the like. The yellow dye is, for example, C.I. pigment yellow 74 and cadmium yellow.

The type of the other material is not particularly limited, but is, for example, a binding agent, an external additive, a release agent, and a charge control agent.

The binding agent primarily binds a coloring agent, etc. The binding agent includes one or two or more types of polymer compounds, such as, e.g., a polyester based resin, a styrene-acrylic based resin, an epoxy based resin, and a styrene-butadiene based resin.

Among them, the binding agent preferably contains a polyester based resin. This is because the toner containing polyester based resin as a binding agent becomes easy to fuse to the medium since the polyester based resin has high affinity to a medium such as paper. This is also because the polyester based resin has high physical strength even when the molecular weight is relatively small, and therefore the developer including a polyester based resin has excellent durability as a binding agent.

The crystal condition of the polyester based resin is not especially limited. Therefore, the polyester based resin may be a crystalline polyester based resin, an amorphous polyester based resin, or both. Among them, it is preferable that the type of the polyester based resin be crystalline polyester. That is because yellow toner becomes more easily fusible by the medium M and the durability of the yellow toner further improves.

This polyester based resin is, for example, a reactant (condensation polymer) of one or two or more alcohols and one or two or more carboxylic acids.

The type of alcohol is not particularly limited, but among other things, it is preferable that it be a dihydric or higher alcohol and its derivative, etc. The dihydric or higher alcohol is, for example, ethylene glycol, diethylene glycol, triethylene glycol, polyethylene glycol, propylene glycol, butanediol, pentanediol, hexanediol, cyclohexanedimethanol, xylene glycol, dipropylene glycol, polypropylene glycol, bisphenol A, hydrogenated bisphenol A, bisphenol A ethylene oxide, bisphenol A propylene oxide, sorbitol, glycerin, etc.

The type of carboxylic acid is not particularly limited, but among other things it is preferable that it be a carboxylic acid having two or more valences and a derivative thereof. The dicarboxylic or higher carboxylic acid is, for example, maleic acid, fumaric acid, phthalic acid, isophthalic acid, terephthalic acid, succinic acid, adipic acid, trimellitic acid, pyromellitic acid, cyclopentanedicarboxylic acid, succinic anhydride, trimellitic anhydride, maleic anhydride, dodecenyl succinic anhydride, etc.

The external additive mainly improves the flowability of the yellow toner by suppressing agglomerate, etc., of yellow toner. The external additive includes, for example, any one or two or more types of inorganic materials, organic materials, etc. The inorganic material is, for example, a hydrophobic silica, etc. The organic material is, for example, a melamine resin, etc.

The release agent mainly improves the fusability, offset resistance, etc., of yellow tonner. The release agent includes any one or two or more types of waxes, such as, e.g., an aliphatic hydrocarbon wax, an oxide of an aliphatic hydrocarbon wax, a fatty acid ester wax, and a deoxidized product of a fatty acid ester wax. Besides this, the release agent may be, for example, a block copolymer of a series of waxes as described above.

Examples of the aliphatic hydrocarbon wax include, for example, low molecular weight polyethylene, low molecular weight polypropylene, a copolymer of olefin, a microcrystalline wax, paraffin wax, and a Fischer Tropsch wax. The oxide of the aliphatic hydrocarbon wax is, for example, an oxidized polyethylene wax. The fatty acid ester wax is, for example, a carnauba wax and a montanic acid ester wax. The deoxidized product of the fatty acid ester wax is a wax in which some or all of the fatty acid ester wax is deoxidized, such as deoxidized carnauba wax.

The charge control agent mainly controls the yellow toner's frictional charge, etc. The charge control agent used for a developer of negative charge toner contains one or two or more types of, for example, azo type complex, salicylic acid type complex, calixarene type complex, etc.

Each of magenta toner, cyan toner, and black toner has the same configuration as yellow toner described above except that, for example, the type of coloring agent is different. The magenta pigment is, for example, quinacridone or the like. The cyan pigment is, for example, phthalocyanine blue (C.I. Pigment Blue 15:3) or the like. The black pigment is, for example, carbon. The magenta dye is, for example, C.I. pigment red 238, etc. The cyan dye is, for example, a pigment blue 15:3, etc. The black dye is, for example, carbon black, and the carbon black is, for example, furnace black and channel black.

The method of producing the toner is not particularly limited. The production method may be, for example, a pulverization method, a polymerization method, or a method other than the methods described above. Of course, the developer may be produced using two or more types of the above-described series of manufacturing methods. This polymerization method is, for example, a dissolve suspension method.

<1-6. Operation>

Next, the operation of the image forming apparatus will be explained.

Hereinafter, after describing the image forming operation, the reverse rotation operation of the development roller 33 will be described.

[Image Forming Operation]

In the case of forming an image on the surface of a medium M, the image forming apparatus performs, as will be described later, for example, a development process, a primary transfer process, a secondary transfer process, and a fusing process in this order, and also performs a cleaning process as the need arises.

(Development Process)

First, the medium M contained in the tray 10 is taken out by the feed roller 20. This medium M taken out by the feed roller 20 is carried along the carrying path R1 by the carrying rollers 61 and 62 in the direction of the arrow F1.

In the development process, when the photosensitive drum 31 is rotated in the developing part 30K, the charge roller 32 applies a DC voltage to the surface of the photosensitive drum 31 while rotating. As a result, the surface of the photosensitive drum 31 is uniformly charged.

Subsequently, based on the edited image data, the light source 37 irradiates light to the surface of the photosensitive drum 31. As a result, the surface potential attenuates (light attenuates) in the light irradiated part on the surface of the photosensitive drum 31, and therefore an electrostatic latent image is formed on the surface of the photosensitive drum 31.

On the other hand, in the developing part 30 K, the black toner stored in the cartridge 39 is discharged toward the supply roller 34.

After the voltage is applied to the supply roller 34, the supply roller 34 rotates. With this, the black toner is supplied to the surface of the supply roller 34 from the cartridge 39.

After the voltage is applied to the development roller 33, the development roller 33 rotates while being press-contacted to the supply roller 34. With this, the black toner supplied to the surface of the supply roller 34 adheres to the surface of the development roller 33, so the black toner is carried using the rotation of the development roller 33. In this case, since the development blade 35 removes a part of the black toner that is being absorbed by the surface of the development roller 33, the thickness of the black toner, which is absorbed by the surface of the development roller 33, is made uniform.

After the photosensitive drum 31 is rotated while being press-contacted to the development roller 33, the black toner that was absorbed by the surface of the development roller 33 is transferred to the surface of the photosensitive drum 31. With this, since the black toner adheres to the surface (electrostatic latent image) of the photosensitive drum 31, a toner image of the black toner is formed.

In this invention, the rotational directions of the various rollers and belts for forming a toner image is defined as a forward rotation. The opposite direction against the forward rotation is defined as a reverse rotation.

[Primary Transfer Process]

In the transfer part 40, when the drive roller 42 is rotated, the driven roller 43 and the backup roller 44 rotate according to the rotation of the drive roller 42. As a result, the intermediate transfer belt 41 moves in the direction of the arrow F5.

In the primary transfer process, a voltage is applied to the primary transfer roller 45K. Since this primary transfer roller 45K is press-contacted to the photosensitive drum 31 via the intermediate transfer belt 41, the toner image of the black toner formed in the above-mentioned development process is transferred to the intermediate transfer belt 41.

Thereafter, the intermediate transfer belt 41 to which the toner image is transferred is subsequently moved in the direction of the arrow F5. As a result, in the developing parts 30C, 30M, and 30Y and the primary transfer rollers 45C, 45M, and 45Y, the development process and the primary transfer process are sequentially performed by the same procedure as the developing part 30K and the primary transfer roller 45K described above. Therefore, since the cyan toner, the magenta toner, and the yellow toner are sequentially transferred to the intermediate transfer belt 41, a toner image of the cyan toner, a toner image of the magenta toner, and a toner image of the yellow toner are formed.

Specifically, since the cyan toner is transferred to the surface of the intermediate transfer belt 41 by the developing part 30C and the primary transfer roller 45C, a toner image of the cyan toner is formed. Subsequently, since the magenta toner is transferred to the surface of the intermediate transfer belt 41 by the developing part 30M and the primary transfer roller 45M, a toner image of the magenta toner is formed. Subsequently, since the yellow toner is transferred to the surface of the intermediate transfer belt 41 by the developing part 30Y and the primary transfer roller 45Y, a tonner image of the yellow toner is formed.

Of course, whether or not the development process and the primary transfer process are actually carried out in the respective developing parts 30C, 30M, and 30Y and primary transfer rollers 45C, 45M, and 45Y depends on the color (combination of colors) required to form an image.

[Secondary Transfer Process]

The medium M carried along the carrying path R1 passes between the backup roller 44 and the secondary transfer roller 46.

In the secondary transfer process, a voltage is applied to the secondary transfer roller 46. Since the secondary transfer roller 46 is press-contacted to the backup roller 44 via the medium M, the toner image transferred to the intermediate transfer belt 41 in the above-described primary transfer process is transferred to the medium M.

[Fuse Process]

After the toner image is transferred to the medium M in the secondary transfer process, the medium M is continuously carried along the carrying path R1 in the direction of the arrow F1, and therefore it is input to the fuser 50.

In the fusing process, the surface temperature of the heat application roller 51 is controlled to be a predetermined temperature. When the pressure application roller 52 is rotated while being press-contacted to the heat application roller 51, the medium M is carried so as to pass between the heat application roller 51 and the pressure application roller 52.

As a result, the toner transferred to the surface of the medium M is heated, and therefore the toner melts. Moreover, since the melted toner is press-contacted to the medium M, the toner firmly adheres to the medium M.

Therefore, according to the edited image data, the toner is fixed so that a specific pattern is formed in a specific region on the surface of the medium M. Thus, an image is formed.

The medium M on which the image was formed is carried along the carrying path R2 in the direction of the arrow F2 by the carrying rollers 63 and 64. As a result, the medium M is ejected to the stacker part 2 from the ejection opening 1H.

The carrying procedure of the medium M is changed according to the format of the image formed on the surface of the medium M.

For example, in cases where images are formed on both sides of the medium M, the medium M that has passed through the fuser 50 is carried along the carrying paths R3 to R5 in the direction of the arrows F3 and F4 by the carrying rollers 65 to 68, and then along the carrying path R1 by the carrying rollers 61 and 62 again in the direction of the arrow F1. In this case, the direction in which the medium M is carried is controlled by the carrying path switching guides 69 and 70. As a result, the development process, the primary transfer process, the secondary transfer process, and the fusing process are performed on the back side of the medium M (the face on which no image has been formed yet).

[Cleaning Process]

In each of the developing parts 30K, 30C, 30M, and 30Y, in some cases, unnecessary toner remains on the surface of the photosensitive drum 31. The unnecessary toner is, for example, a part of toner used in the primary transfer process that was not transferred to the intermediate transfer belt 41 and remained on the surface of the photosensitive drum 31.

Therefore, in each of the developing parts 30K, 30C, 30M, and 30Y, since the photosensitive drum 31 rotates in a state in which it is press-contacted to the cleaning blade 36, the toner remaining on the surface of photosensitive drum 31 is scraped by the cleaning blade 36. As a result, the unnecessary toner is removed from the surface of the photosensitive drum 31.

Further, in the transfer part 40, in the primary transfer process, in some cases, a part of developer transferred to the surface of the intermediate transfer belt 41 is not transferred to the surface of the medium M in the secondary transfer process, and remains on the surface of the intermediate transfer belt 41.

Therefore, in the transfer part 40, when the intermediate transfer belt 41 moves in the direction of the arrow F5, the toner remaining on the surface of the intermediate transfer belt 41 is scraped by the cleaning blade 36. As a result, the unnecessary toner is removed from the surface of the intermediate transfer belt 41.

With this, the image forming operation is completed.

[Reverse Rotation Operation of Development Roller]

As will be described below, the image forming apparatus performs a reverse rotation operation of the development roller 33 as necessary, while performing the aforementioned image forming operation.

Figure 8:
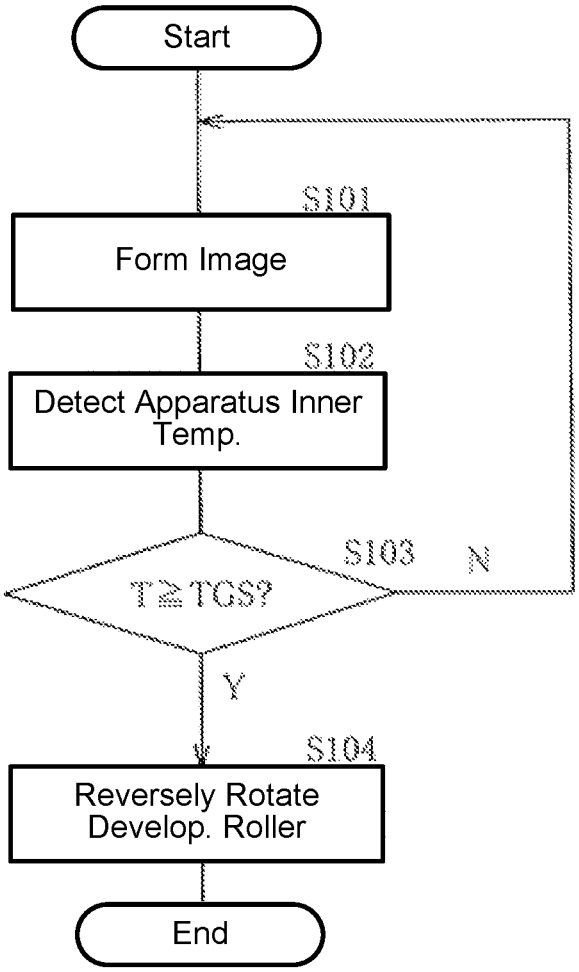
FIG. 8 is a flowchart for explaining the operation of the image forming apparatus.

FIG. 8 shows the flow for explaining the operation of the image forming apparatus. FIG. 8 shows a flow when the image forming apparatus performs the reverse rotation operation of the development roller 33 only once. In the following description, reference is made to FIGS. 1 to 7 from time to time.

Noted that the bracketed step numbers described below correspond to the step numbers shown in FIG. 8.

Before the use of the image forming apparatus, for example, for the purpose of enabling the image forming apparatus to perform the reverse rotation operation of the development roller 33 based on the glass transition starting temperature TGS, the glass transition starting temperature TGS specified according to the type of toner (glass transition temperature Tg) is stored in the editing memory 74.

That is, when the toner A is used to form an image, the glass transition starting temperature TGS=46° C. is registered in the editing memory 74. Further, when the toner B is used to form an image, the glass transition starting temperature TGS=51° C. is registered in the editing memory 74.

The development process, the primary transfer process, the secondary transfer process, and the fusing process are performed in this order to form an image on the surface of the medium M (S101). Thereafter, the temperature sensor 78 detects the temperature in the vicinity of the transfer belt 41 as the apparatus inner temperature T (S102).

Subsequently, the temperature judgment part 96 judges whether or not the apparatus inner temperature T is equal to or higher than the glass transition starting temperature TGS (S103). In cases where the image forming apparatus is cooled sufficiently due to the fact that the image forming apparatus is not used or the image forming apparatus is used intermittently, the apparatus inner temperature T is likely to be lower than the glass transition starting temperature TGS. In contrast, when the image forming apparatus is continuously used, or even if the image forming apparatus is used intermittently but the frequency of use becomes high, the developing part 30 continuously performing the development process generates heat due to frictional heat, etc., and therefore the apparatus inner temperature T tends to rise.

When the apparatus inner temperature T is less than the glass transition starting temperature TGS (S103 N), the apparatus inner temperature T has not been raised to the extent that the toner begins to agglomerate, and therefore the temperature judgment part 96 judges that the possibility of image quality deterioration due to the toner agglomerate is low. Therefore, the temperature judgment part 96 does not output a reverse rotation signal to the roller driving control part 84. In this case, the process returns to the image forming process (S101) to perform the judging operation (S103) of the apparatus inner temperature T.

On the other hand, when the "apparatus inner temperature T" is equal to or higher than the glass transition starting temperature TGS (S103 Y), the apparatus inner temperature T has been raised to the extent that the toner agglomerates, and therefore the temperature judgment part 96 judges that the possibility of image quality deterioration due to the toner agglomerate is high. Therefore, the temperature judgment part 96 outputs a reverse rotation signal to the roller driving control part 84.

Finally, the roller driving control part 84 reversely rotates the development roller 33 in accordance with the reverse rotation signal before the next image forming operation is performed after completion of the image forming operation (S104). That is, referring to FIGS. 1 and 2, the roller driving control part 84 rotates the development roller 33 in the clockwise direction in accordance with the rotation of the photosensitive drum 31 during the image formation, whereas at the time of the reverse rotation of the development roller 33, the roller driving control part 84 rotates the development roller 33 counterclockwise.

The conditions, such as, e.g., the rotation speed (linear velocity), the rotation angle, and the rotation time at the time of the reverse rotation of the development roller 33, can be arbitrarily set.

Due to the reverse rotation operation of the development roller 33, the development roller 33 rotates in a direction opposite to the rotational direction (or forward rotational direction) at the time of forming the image while being pressed against the photosensitive drum 31. As a result, even if the toner agglomerate exists between the photosensitive drum 31 and the development roller 33 and in the vicinity thereof due to thermal damage of the toner and deterioration of the toner, agglomerate is removed from the photosensitive drum 31.

The fact that the agglomerate becomes likely to fall off according to the reverse rotation operation of the development roller 33 is also the same with respect to the agglomerate existing between the photosensitive drum 31 and the cleaning blade 36 and the vicinity thereof.

Moreover, even if the growth process of the agglomerate has not been progressed to the extent that macroscopic agglomerate is generated since the apparatus inner temperature T has not been raised sufficiently, the microscopic agglomerate is removed according to the reverse rotation operation of the development roller 33. Thus, the growth itself of the agglomerates is prevented.

Therefore, at the time of forming the image after the reverse rotation of the development roller 33, the agglomerate becomes less likely to be present on the surface of the photosensitive drum 31, and therefore, due to the presence of the agglomerate, occurrence of vertical white streaks (color loss) is suppressed.

With this, the reverse rotation operation of the development roller 33 is completed.

In the present invention, the reverse rotation operation may be initiated at various timing in the light of avoiding the toner agglomeration. The reverse rotation operation may start when a predetermined period passes after a high apparatus inner temperature is detected. The predetermined period is practically ranged from 10 msec. to 100 msec. The period, however, may be less or more than that range.

<1-7. Functions and Effects>

In this image forming apparatus, since the glass transition starting temperature TGS is specified based on the DDSC curve D relating to the toner, and the development roller 33 is reversely rotated when the apparatus inner temperature T is equal to or higher than the glass transition starting temperature TGS, high quality images can be stably obtained for the following reasons.

To suppress occurrence of vertical white streaks in images due to the existence of toner agglomerate, as described in the aforementioned technical background, reverse rotation of the photosensitive drum 31 at the time of each completion of the image forming operation (at the time of the developing operation) has been proposed. In this case, even if agglomerate which becomes an occurrence factor of vertical white streaks unintentionally occur, since the agglomerate is removed using the reverse rotation operation of the photosensitive drum 31, high quality images can be obtained.

However, when the photosensitive drum 31 is reversely rotated after each completion of the image forming operation, the frequency (or the number of times) that the photosensitive drum 31 reversely rotates increases significantly. In this case, since the frequency of the unusual operation (reverse rotation operation) that is different from the forward rotation operation of the photosensitive drum 31 increases, the press-contacted state of each of the development roller 33 and the cleaning blade 36 that are press-contacted to the photosensitive drum 31 becomes easily varied. When the press-contacted state varies, since it becomes difficult for the toner to transfer from the surface of the development roller 33 to the surface of the photosensitive drum 31 and it becomes difficult for the cleaning blade 36 to scrape the surface of the photosensitive drum 31, density irregularities occur more easily in images, and vertical white streaks due to other factors such as foreign bodies occur more easily in images. Not only that, when the frequency of the reverse rotation of the photosensitive drum 31 increases excessively, the photosensitive drum 31 can be more easily damaged and the development roller 33 and the cleaning blade 36 become more easily damaged. When the photosensitive drum 31, etc., is damaged, it obviously becomes difficult to form images normally.

Further, when the photosensitive drum 31 is reversely rotated, since the development roller 33 that is press-contacted to the photosensitive drum 31 also reversely rotates accordingly, the development seal 38 that is press-contacted to the development roller 33 repeats a deformation after each reverse rotation in which it bends and returns to its original state. In this case, when the frequency that the photosensitive drum 31 reversely rotates increases, since the development seal 38 is fatigued due to the repeated deformation, the development seal 38 is more easily stretched, and more easily broken depending on the case. With this, when it becomes difficult for the development seal 38 to seal the gap between the development roller 33 and the housing 30Z, since a so-called toner leakage occurs, the toner is easily discharged to the outside via the opening 30ZK1 unintentionally. When the toner is discharged to the outside, since a large amount of unnecessary toner is directly supplied to the surface of the intermediate transfer belt 41, it becomes difficult to form images normally.

From that, when reversely rotating the photosensitive drum 31 every time the image forming operation is completed, occurrence of the vertical white streaks due to the existence of toner agglomerate can be suppressed. However, there is a possibility that vertical white streaks occur due to other causes such as foreign bodies and it might become difficult to normally form images in the first place due to the damage of the photosensitive drum 31, etc., and the supply of unnecessary toner, etc. Therefore, it is difficult to stably obtain high quality images.

On the other hand, when the development roller 33 is reversely rotated when the apparatus inner temperature T is equal to or higher than the glass transition starting temperature TGS, the development roller 33 is reversely rotated only in a case in which the apparatus inner temperature T meets the predetermined condition (equal to or higher than the glass transition starting temperature TGS). Therefore, the frequency that the development roller 33 reversely rotates is significantly fewer in comparison to when the photosensitive drum 31 is reversely rotated every time the image forming operation is completed. With this, since the press-contacted state of each of the photosensitive drum 31 and the development blade 35 to the development roller 33 becomes less likely to vary, density irregularities become less likely to occur in images, and vertical white streaks due to other causes such as foreign bodies, etc., become less likely to occur in images. In this case, obviously, since the development roller 33 becomes less likely to be damaged and the photosensitive drum 31 and the development blade 35 become also less likely to be damaged, images can be more easily formed normally.

Also, when the frequency that the development roller 33 reversely rotates decreases, the development seal 38 becomes less likely to be fatigued. With this, since the state in which the development seal 38 seals the gap between the development roller 33 and the housing 30Z is more easily maintained, toner leakage is less likely to occur. Therefore, since a large amount of unnecessary toner becomes less likely to be directly supplied to the surface of the intermediate transfer belt 41, it becomes easy to normal form images.

Moreover, when the apparatus inner temperature T becomes equal to or higher than the glass transition starting temperature TGS, that is, when the toner state has reached a state that microscopic agglomerate begins to start, the development roller 33 reversely rotates for the first time. Therefore, in a proper state in which there is a possibility that agglomerate actually occurs, the reverse rotation operation of the development roller 33 is performed to remove the agglomerate. In this case, not only the frequency of reversely rotating the development roller 33 is reduced, but also the frequency that the development roller 33 reversely rotates decreases while reversely rotating the development roller 33 at an appropriate timing capable of removing the agglomerate and preventing occurrence of agglomerate. With this, the frequency that the development roller 33 reversely rotates can be sufficiently suppressed while ensuring that an image can be normally formed.

From these facts, in the case of reversely rotating the development roller 33 according to the comparison result between the apparatus inner temperature T and the glass transition starting temperature TGS, by suppressing the difficulty of normally forming an image due to breakage of the development roller 33, etc., and supply of unnecessary toner, it is possible to suppress occurrence of vertical white streaks due to the presence of agglomerate and foreign objects while ensuring that an image can be normally formed. Therefore, a high-quality image can be stably obtained.

2. Modified Example

The structure and operation of the image forming apparatus may be changed as appropriate as described below.

Modified Example 1

For example, the temperature of the transfer part 41 (intermediate transfer belt 41) is detected as the apparatus inner temperature T is detected, but the installation location of the temperature sensor 78 can be arbitrarily changed.

Figure 9:
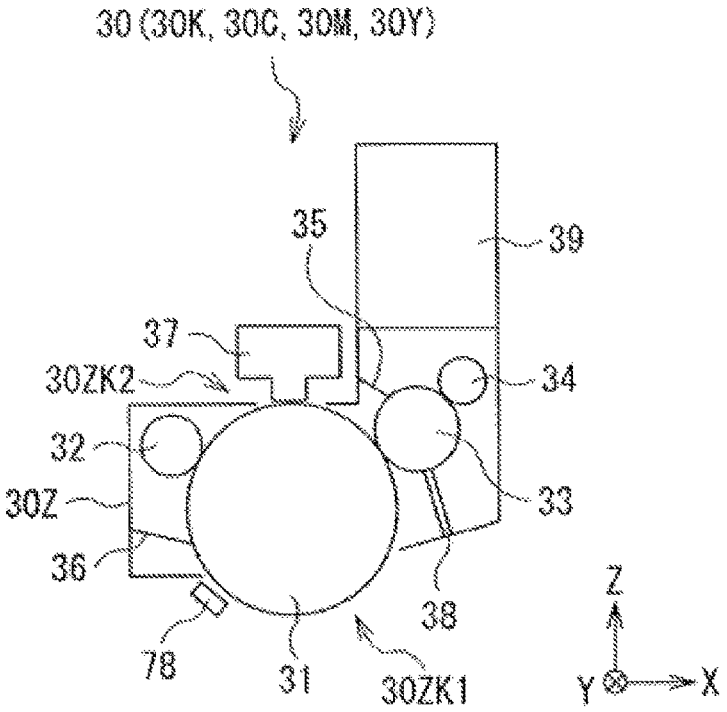
FIG. 9 is a plan view showing the configuration of an image forming apparatus according to Modified Example 1.
Figure 10:
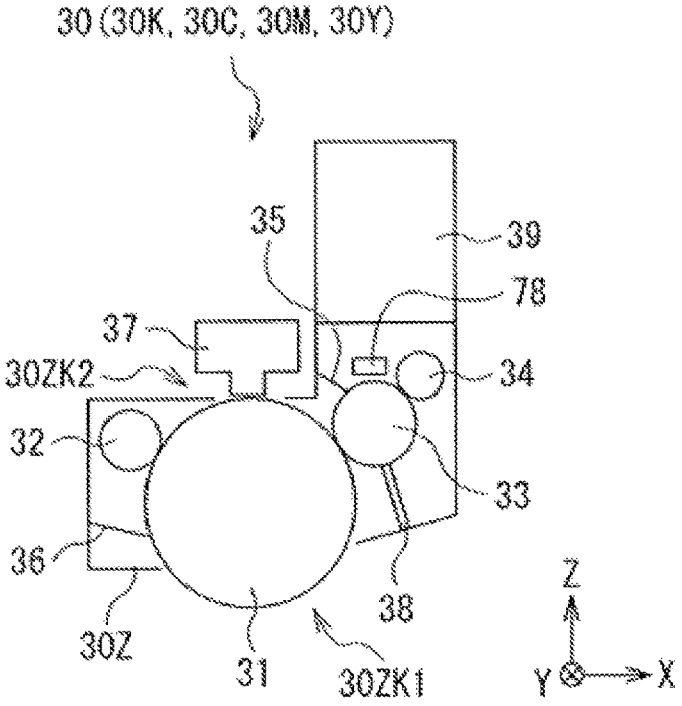
FIG. 10 is a plan view showing another configuration of the image forming apparatus of Modified Example 1.
Figure 11:
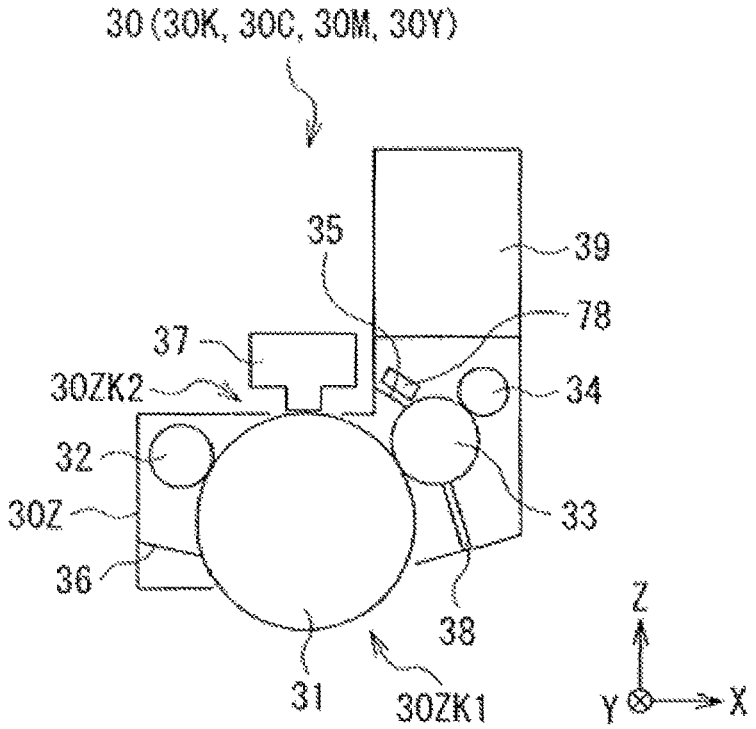
FIG. 11 is a plan view showing another configuration of the image forming apparatus of Modified Example 1.
Figure 12:
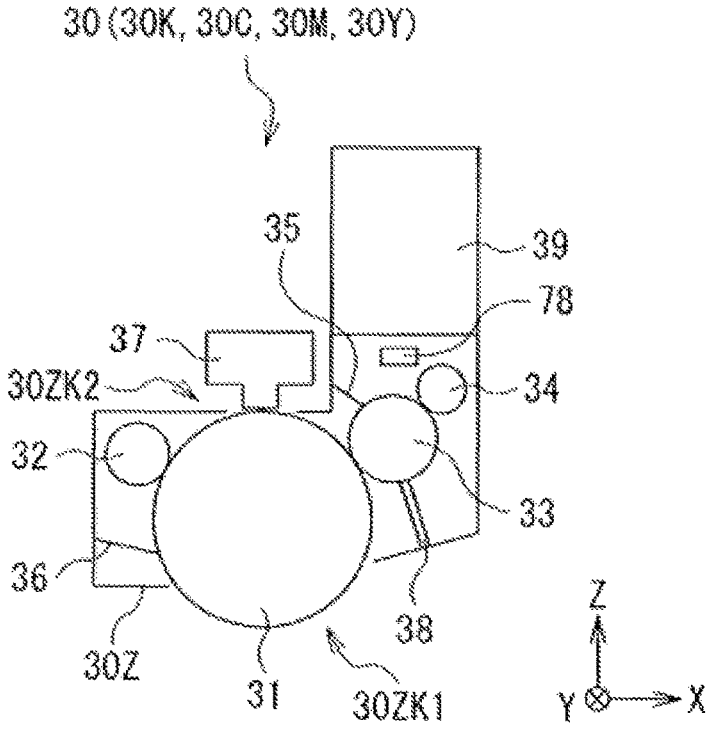
FIG. 12 is a plan view showing another configuration of the image forming apparatus of Modified Example 1.

Specifically, for example, as shown in FIGS. 9 to 12 corresponding to FIG. 2, the installation location of the temperature sensor 78 may be changed. In this case, for example, as shown in FIG. 9, by setting the temperature sensor 78 in the vicinity of the photosensitive drum 31, the temperature of the photosensitive drum 31 may be detected as the apparatus inner temperature T. For example, as shown in FIG. 10, by setting the temperature sensor 78 in the vicinity of the development roller 33, the temperature of the development roller 33 may be detected as the apparatus inner temperature T. For example, as shown in FIG. 11, by setting the temperature sensor 78 in the vicinity of the development blade 35, the temperature of the development blade 35 may be detected as the apparatus inner temperature T. For example, as shown in FIG. 12, by setting the temperature sensor 78 in the space provided in the housing 30Z, the temperature of the space may be detected as the apparatus inner temperature T. Among them, since the quality of the image (state of occurrence of vertical white streaks) depends on the toner agglomerate state and the temperature in the vicinity of the development roller 33 greatly affects the agglomerate state of the toner, it is preferable that the installation location of the temperature sensor 78 be as close as possible to the development roller 33. In the invention, the apparatus inner temperature may be measured somewhere from toner cartridges (or containers) to a photosensitive drum. The temperature may be measured inside these sections or in the vicinity of these sections.

Also in these cases, it is possible to reversely rotate the photosensitive drum 31 when the apparatus inner temperature T is equal to or higher than the glass transition starting temperature TGS, and therefore the same effect can be obtained.

Modified Example 2

Further, for example, when the development roller 33 rotates in the reverse direction, in addition to the comparison operation between the apparatus inner temperature T and the glass transition starting temperature TGS, a determination operation of a frequency F of forming toner images may be performed. Herein, the frequency F means the number of how many times toner images are formed.

Figure 13:
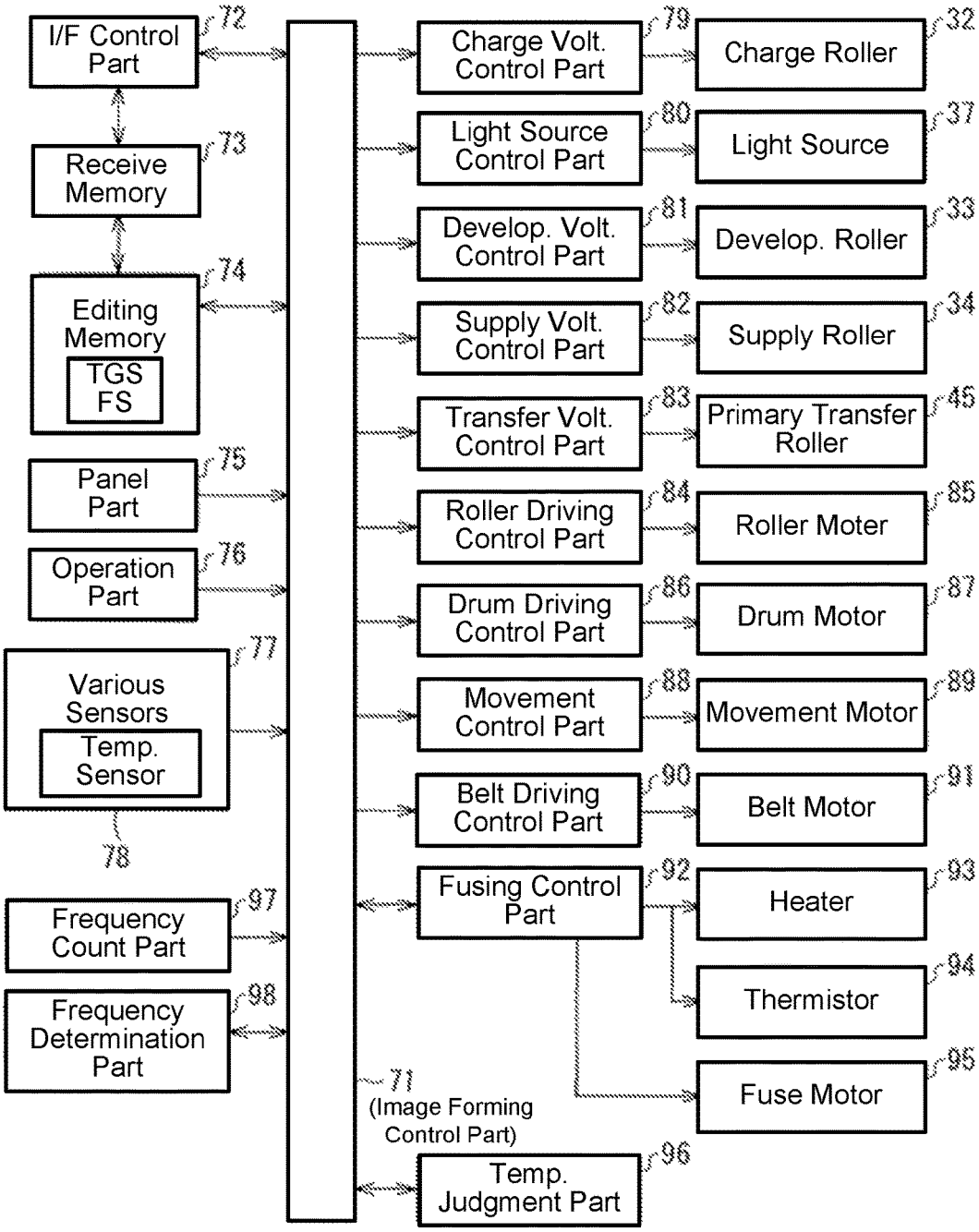
FIG. 13 is a block diagram showing a configuration of an image forming apparatus according to Modified Example 2.
Figure 14:
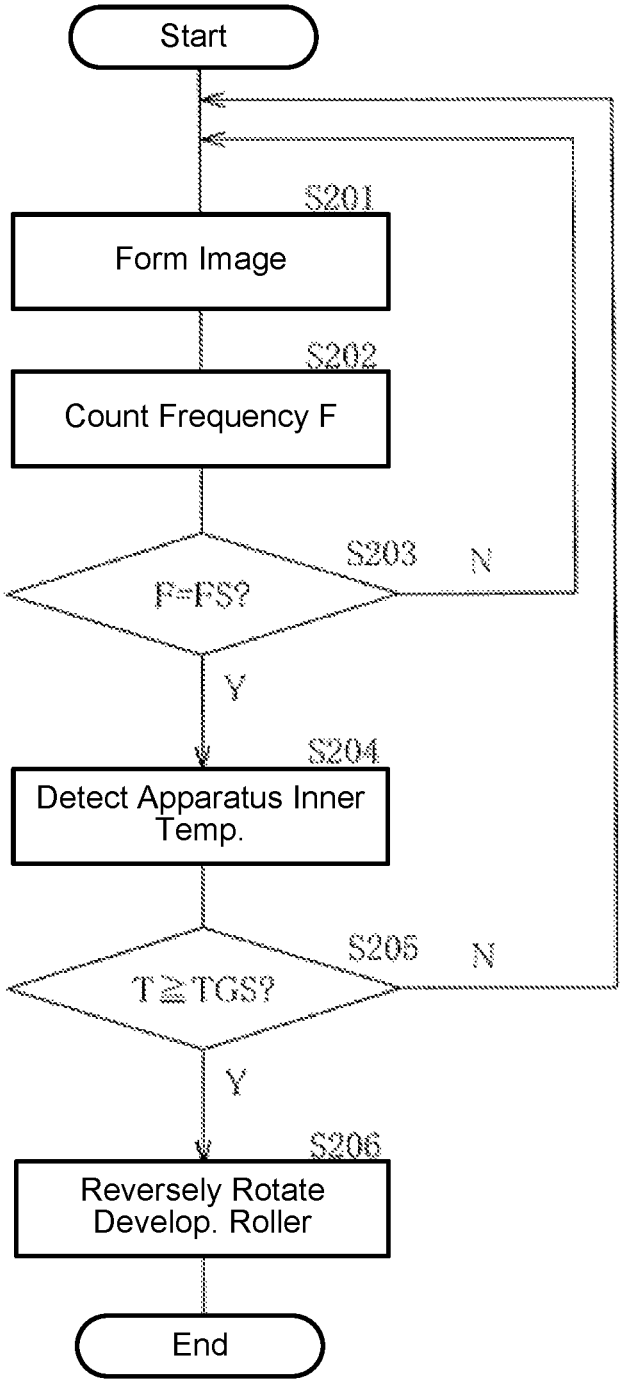
FIG. 14 is a flowchart for explaining the operation of the image forming apparatus shown in FIG. 13.

FIG. 13 shows a modified example relating to the configuration of the image forming apparatus, and shows a block configuration corresponding to FIG. 3. FIG. 14 shows a flow of operations corresponding to FIG. 8 in order to explain the operation of the image forming apparatus shown in FIG. 13.

The structure of this image forming apparatus is the same as the structure (see FIG. 3) of the image forming apparatus of the embodiment described above, for example, except as described below, as shown in FIG. 13. Specifically, the image forming apparatus further includes, for example, a frequency count part 97 and the frequency determination part 98. In this case, the image forming control part 71, the roller driving control part 84, the temperature judgment part 96, the frequency count part 97, and the frequency determination part 98 are the "control part" according to one embodiment of the present invention.

The frequency count part 97 mainly counts the frequency F that the toner images are formed (or the number of how many times toner images are formed). The timing at which the frequency count part 97 starts counting the frequency F is not particularly limited, but may be, for example, immediately after turning on the power of the image forming apparatus and after completion of the reverse rotation operation of the photosensitive drum 31. At these timings, for example, since the frequency F is reset as will be described later, the frequency count part 97 starts counting the frequency F again.

The frequency determination part 98 mainly determines whether or not the frequency F has reached the target frequency FS based on the frequency F counted by the frequency count part 97. The target frequency FS is not particularly limited, but is, for example, 40 times. For example, when it is determined that the frequency F has reached the target frequency FS, the frequency determining part 98 outputs a permission signal to the roller driving control part 84 so as to permit the reverse rotation operation of the development roller 33 by the roller driving control part 84.

The operation of this image forming apparatus is the same as the operation (see FIG. 8) of the image forming apparatus of the embodiment described above, for example, except as described below, as shown in FIG. 14.

Specifically, before using the image forming apparatus, for example, in order to enable the image forming apparatus to perform the reverse rotation operation of the development roller 33 according to the frequency F, the target frequency FS together with the glass transition starting temperature TGS are stored in the editing memory 74.

In the case of performing the reverse rotation operation of the development roller 33, after an image is formed on the surface of the medium M by performing an image forming operation (development process, primary transfer process, secondary transfer process, and fusing process) (S201), the frequency count part 97 counts the frequency F that the toner images are formed (S202).

Subsequently, the frequency determination part 98 judges whether or not the frequency F has reached the target frequency FS (S203). When the frequency F has not reached the target frequency FS (S203 N), the process returns to the image forming process (S201). On the other hand, when the frequency F has reached the target frequency FS (S203 Y), a process regarding the reverse rotation operation of the development roller 33 (see FIG. 8) is performed.

Specifically, after the temperature sensor 78 detects the apparatus inner temperature T (S204), the temperature judgment part 96 judges whether or not the apparatus inner temperature T is equal to or higher than the glass transition starting temperature TGS (S205). When the apparatus inner temperature T is lower than the glass transition starting temperature TGS (S205N), the process returns to the image forming process (S201). On the other hand, if the apparatus inner temperature T is equal to or higher than the glass transition starting temperature TGS (S205 Y), the roller driving control part 84 reversely rotates the development roller 33 according to the reverse rotation signal (S206). With this, the reverse rotation operation of the development roller 33 taken into consideration of the frequency F is completed.

In this case, since the reverse rotation operation of the development roller 33 is performed after the frequency F has reached the target frequency FS, the frequency that the development roller 33 reversely rotates is reduced. Therefore, the development roller 33 and the like become less likely to be damaged, and the development seal 38 becomes less likely to fatigue, so a higher effect can be obtained.

Modified Example 3

Further, for example, as explained with reference to FIGS. 4 to 7, the temperature corresponding to the intersection B (hereinafter referred to as "intersection temperature") is set as the glass transition starting temperature TGS. Considering conditions and operation status of the apparatus, the glass transition starting temperature TGS may be determined within 5% range of the intersection B.

In this case, the glass transition starting temperature TGS may be set to be higher than the intersection temperature, or the glass transition starting temperature TGS may be set to be lower than the intersection temperature. In particular, it is preferable to set to be lower the glass transition starting temperature TGS rather than the intersection temperature. In the temperature range higher than the intersection temperature, as described above, the toner becomes likely to microscopically agglomerate. Therefore, in order to suppress occurrence of vertical white streaks in the image due to the toner agglomerate, it is preferable to set the glass transition starting temperature TGS to be lower than the intersection temperature. That is, by setting the glass transition starting temperature TGS so as to be lower than the intersection temperature, the reverse rotation operation of the development roller 33 is performed in the temperature range where the toner is not microscopically agglomerated. Therefore, it is possible to further prevent vertical white streaks from appearing in the image due to toner agglomerate.

However, when setting the glass transition starting temperature TGS so as to be lower than the intersection temperature, if the glass transition starting temperature TGS is set to be too low, there is a possibility that the frequency of reversely rotating the development roller 33 becomes many. Therefore, when setting the glass transition starting temperature TGS to be lower than the intersection temperature, for example, it is preferable to set the glass transition starting temperature TGS so that the intersection temperature becomes −1° C., it is more preferable to set the glass transition starting temperature TGS so that the intersection temperature is −0.5° C., and it is still more preferable to set the glass transition starting temperature TGS so that the intersection temperature is −0.1° C. This is because occurrence of vertical white streaks caused by the toner agglomerate is suppressed while suppressing the frequency that the development roller 33 reversely rotates.

Modified Example 4

In each case shown in FIGS. 3 and 13, a roller driving control part 84 and a temperature judgment part 96 were used together with the image forming control part 71 to perform the reverse rotation operation of the development roller 33.

However, instead of using the roller driving control part 84, the image forming control part 71 may also serve as the function of the roller driving control part 84. Also, instead of using the temperature judgment part 96, the image forming control part 71 may also serve as the function of the temperature judgment part 96. Further, instead of using each of the roller driving control part 84 and the temperature judgment part 96, the image forming control part 71 may serve as the function of each of the roller driving control part 84 and the temperature judgment part 96. Even in these cases, the same effects can be obtained.

In the case shown in FIG. 13, in order to perform the reverse rotation operation of the development roller 33, the frequency count part 97 and the frequency determination part 98 are used together with the image forming control part 71.

However, instead of using the frequency count part 97, the image forming control part 71 may also serve as the function of the frequency count part 97. Further, instead of using the frequency determination part 98, the image forming control part 71 may also serve as the function of the frequency determination part 98. Also, instead of using each of the frequency count part 97 and the frequency determination part 98, the image forming control part 71 may also serve as the function of each of the frequency count part 97 and the frequency determination part 98. Even in this case, the same effects can be obtained.

Example

Examples of the present invention will be described in detail. The order of description is as follows.

Experiment Examples 1-1 to 1-20

While changing the apparatus inner temperature T (the temperature of the intermediate transfer belt 41), images were formed on surfaces of media by using toner A (black toner) by performing a reverse rotation operation of the development roller 33 based on the apparatus inner temperature T and the glass transition starting temperature TGS. After that, the qualities of the images were examined.

The details on the apparatus inner temperature T are as shown in Table 1. That is, the apparatus inner temperature T was changed within the range of 40° C. to 52° C. The glass transition starting temperature TGS for the toner A is 46° C. as described above.

The composition of the toner A is as follows.

Black coloring agent: 4 parts by mass of black pigment (MOGUL-L manufactured by Cabot Corporation);

Binding agent: 70 parts by mass of amorphous polyester (OCR-40 manufactured by Kao Corporation) and 20 parts by mass of amorphous polyester (OCR-4 manufactured by Kao Corporation), and 10 parts by mass of crystalline polyester (OCR-13 manufactured by Kao Corporation);

External additive: 2.5 parts by mass of hydrophobic silica (R972 manufactured by Nippon Aerosil Co., Ltd.) and 2 parts by mass of hydrophobic silica (RY-50 manufactured by Nippon Aerosil Co., Ltd.);

Release agent: 3 parts by mass of Carnauba wax No. 1 manufactured by S. Kato & Co.; and Charge control agent: 0.2 parts by mass of Bontron E-84 manufactured by Orient Chemical Industries, Ltd.

In the case of forming an image, as an image forming apparatus, a color printer, MC863 manufactured by Oki Data Co., Ltd., was used, and as a medium, a color printer sheet, Excellent White A4, manufactured by Oki Data Corp., was used. In this case, the image forming apparatus was left for 12 hours in an environment of high temperature and high humidity (temperature=28° C., humidity=80%), and an image was continuously formed using the image forming apparatus. The printing direction of the image was set as the longitudinal direction of the medium, and the type of the image was set as a solid image (printing rate=100%). The conditions related to the reverse rotation operation of the development roller 33 were: linear speed=150 mm/s; and rotation time=40 ms.

When examining the quality of the image, the quality (image quality) of the image was evaluated by visually checking the image, and the results shown in Table 1 were obtained. In this case, the case in which no vertical white streaks occurred in the image was evaluated as "A", and the case in which vertical white streaks occurred in the image was evaluated as "C".

For comparison, images were formed on the surfaces of the media and the qualities of the images were evaluated by the same procedure except that the reverse rotation operation of the development roller 33 was not performed.

TABLE 1

Toner: Toner A, Glass Transition Starting Temp. (TGS) = 46° C.

| Example | Apparatus Inner Temp. T (° C.) | Reverse Rotation Operation | Image Quality Evaluation |
|---|---|---|---|
| 1-1 | 40 | OFF | A |
| 1-2 | 41 | OFF | A |
| 1-3 | 42 | OFF | A |
| 1-4 | 44 | OFF | A |
| 1-5 | 45 | OFF | A |
| 1-6 | 46 | OFF | C |
| 1-7 | 48 | OFF | C |
| 1-8 | 49 | OFF | C |
| 1-9 | 51 | OFF | C |

TABLE 1-continued

Toner: Toner A, Glass Transition Starting Temp. (TGS) = 46° C.

| Example | Apparatus Inner Temp. T (° C.) | Reverse Rotation Operation | Image Quality Evaluation |
|---|---|---|---|
| 1-10 | 52 | OFF | C |
| 1-11 | 40 | ON | A |
| 1-12 | 41 | ON | A |
| 1-13 | 42 | ON | A |
| 1-14 | 44 | ON | A |
| 1-15 | 45 | ON | A |
| 1-16 | 46 | ON | A |
| 1-17 | 48 | ON | A |
| 1-18 | 49 | ON | A |
| 1-19 | 51 | ON | A |
| 1-20 | 52 | ON | A |

In the case where the reverse rotation operation of the development roller 33 was not performed (Experiment Examples 1-1 to 1-10), when the apparatus inner temperature T was equal to or lower than 45° C., no vertical white streaks occurred in the image. However, when the apparatus inner temperature T became equal to or higher than 46° C., vertical white streaks occurred in the image.

On the other hand, when the reverse rotation operation of the development roller 33 was performed (Experiment Examples 1-11 to 1-20), even if the apparatus inner temperature T became equal to or higher than 46° C., no vertical white streaks appeared in the image. Of course, when the apparatus inner temperature T was equal to or lower than 45° C., no white vertical streaks appeared in the image.

The temperature threshold (45° C. to 46° C.) at which the difference occurs in the presence or absence of occurrence of vertical white streaks depending on the presence or absence of the reverse rotation operation of the development roller 33 almost corresponds to the glass transition starting temperature TGS (=46° C.) related to the toner A. Therefore, in the case of using the toner A, by reversely rotating the development roller 33 when the apparatus inner temperature T became equal to or higher than the glass transition starting temperature TGS, the occurrence of the vertical white streaks in the image was it was effectively suppressed while maintaining the frequency of the reverse rotation of the development roller 33 low.

Experimental Examples 2-1 to 2-20

An image was formed on the surface of the medium and the quality of the image was examined by the same procedure as in Experimental Examples 1-1 to 1-10 except that the toner B (black toner) was used instead of the toner A, the results shown in Table 2 were obtained. The glass transition starting temperature TGS for the toner B was 51° C. as described above.

The composition of the toner B was the same as that of the toner A except that the binding agent did not contain crystalline polyester (OCR-13 manufactured by Kao Corporation).

TABLE 2

Toner: Toner B, Glass Transition Starting Temp. (TGS) = 51° C.

| Example | Apparatus Inner Temp. T (° C.) | Reverse Rotation Operation | Image Quality Evaluation |
|---|---|---|---|
| 2-1 | 40 | OFF | A |
| 2-2 | 41 | OFF | A |

TABLE 2-continued

| Toner: Toner B, Glass Transition Starting Temp. (TGS) = 51° C. | | | |
|---|---|---|---|
| Example | Apparatus Inner Temp. T (° C.) | Reverse Rotation Operation | Image Quality Evaluation |
| 2-3 | 42 | OFF | A |
| 2-4 | 44 | OFF | A |
| 2-5 | 45 | OFF | A |
| 2-6 | 46 | OFF | A |
| 2-7 | 48 | OFF | A |
| 2-8 | 49 | OFF | A |
| 2-9 | 51 | OFF | C |
| 2-10 | 52 | OFF | C |
| 2-11 | 40 | ON | A |
| 2-12 | 41 | ON | A |
| 2-13 | 42 | ON | A |
| 2-14 | 44 | ON | A |
| 2-15 | 45 | ON | A |
| 2-16 | 46 | ON | A |
| 2-17 | 48 | ON | A |
| 2-18 | 49 | ON | A |
| 2-19 | 51 | ON | A |
| 2-20 | 52 | ON | A |

In the case of using the toner B (Table 2), the same tendency as in the case of using the toner A (Table 1) was obtained.

Specifically, in the case where no reverse rotation operation of the development roller 33 was performed (Experimental Examples 2-1 to 2-10), when the apparatus inner temperature T was equal to or less than 49° C., no vertical white streaks occurred in the image. However, when the apparatus inner temperature T became 51° C. or higher, vertical white streaks occurred in the image.

On the other hand, in the case where the reverse rotation operation of the development roller 33 was performed (Experimental Examples 2-11 to 2-20), even if the apparatus inner temperature T became 51° C. or higher, no vertical white streaks appeared in the image. Of course, when the apparatus inner temperature T became equal to or lower than 49° C., no vertical white streaks occurred in the image.

Also in this case, the temperature threshold (49° C. to 51° C.) at which the presence or absence of occurrence of vertical white streaks occurs depending on the presence or absence of the reverse rotation operation of the development roller 33 almost corresponds to the glass transition starting temperature TGS (=51° C.). Therefore, in the case of using the toner B, by rotating the development roller 33 in the reverse direction when the apparatus inner temperature T became equal to or higher than the glass transition starting temperature TGS, it was possible to effectively suppress the occurrence of vertical white streaks in the image while suppressing the frequency that the development roller 33 rotated in the reverse direction.

From the results shown in Table 1 and Table 2, it was confirmed that by rotating the development roller 33 in the reverse direction when the apparatus inner temperature T became equal to or higher than the glass transition starting temperature TGS, it was possible to effectively suppress the occurrence of vertical white streaks in the image while suppressing the frequency that the development roller 33 rotated in the reverse direction. Therefore, it was possible to stably obtain a high quality image.

Although the present invention was described with reference to one embodiment, the present invention is not limited to the embodiment described in the aforementioned embodiment, and various variations are possible.

Specifically, for example, the image forming system of the image forming apparatus according to an embodiment of the present invention is not limited to an intermediate transfer system using an intermediate transfer belt, but may be another image forming system. Other image forming methods include, for example, an image forming method not using an intermediate transfer belt. In the image forming method not using an intermediate transfer belt, the toner adhered to the latent image is not indirectly transferred to the medium via the intermediate transfer belt, and the toner adhered to the latent image is directly transferred to the medium.

Further, for example, the image forming apparatus according to an embodiment of the present invention is not limited to a printer, and may be a copying machine, a facsimile machine, a multifunction machine, or the like.

What is claimed is:

1. An image forming apparatus, comprising:

an image forming unit that includes an image carrier having a surface on which a latent image is formed, and a developer carrier which rotates in a predetermined direction and makes toner adhere to the latent image formed on the surface of the image carrier, and develops the latent image into a toner image;

a transfer part that transfers the toner image formed by the image forming unit on a medium;

a fuser that fuses the toner image transferred by the transfer part on the medium;

a temperature detecting part that detects an apparatus inner temperature; and a control part that rotates the developer carrier in the predetermined direction when the latent image is developed and in an opposite direction to the predetermined direction when the apparatus inner temperature detected by the temperature detecting part is equal to or higher than a glass transition starting temperature, wherein the glass transition starting temperature is defined as a temperature corresponding to an intersection between a base line and a glass transition start judgment tangent line, which are specified based on a differential curve of a differential scanning calorimetry (DSC) curve of the toner measured using a DSC method, herein the horizontal axis of the DSC curve: temperature (° C.), the vertical axis of the DSC curve: calorific differential value (μW/° C.), the base line is a line along an initial section of the DSC curve in which the calorific differential value is approximately constant with respect to the calorific differential value, the glass transition start judgment tangent line is a tangent line which is in contact with the differential curve at an intersection between the differential curve and a glass transition start judgment line that is a line of which the calorific differential values are 1.5 times greater than those of the base line.

2. The image forming apparatus according to claim 1, wherein the control part includes a temperature judgment part that judges whether or not the apparatus inner temperature is equal to or higher than the glass transition starting temperature.

3. The image forming apparatus according to claim 1, wherein the control part includes a rotation control part that performs a reverse rotation operation in which the developer carrier is rotated in the opposite direction.

4. The image forming apparatus according to claim 1, wherein the apparatus inner temperature is a temperature of the transfer part.

5. The image forming apparatus according to claim 1, wherein the apparatus inner temperature is a temperature of the developer carrier.

6. The image forming apparatus according to claim 1, wherein the apparatus inner temperature is a temperature of the image carrier.

7. The image forming apparatus according to claim 1, wherein the apparatus inner temperature is a temperature in the image forming unit.

8. The image forming apparatus according to claim 1, wherein the control part is configured to count the frequency that the toner images are formed and rotate the developer carrier in a direction opposite to the predetermined direction when the frequency has reached a target number.

9. The image forming apparatus according to claim 3, wherein during the reverse rotation operation by the rotation control part, the developer carrier rotates 360 degrees or more around a rotational axis thereof.

* * * * *